US009662551B2

(12) United States Patent
Akiyama et al.

(10) Patent No.: US 9,662,551 B2
(45) Date of Patent: May 30, 2017

(54) GOLF CLUB HEAD OR OTHER BALL STRIKING DEVICE HAVING IMPACT-INFLUENCING BODY FEATURES

(71) Applicant: NIKE, Inc., Beaverton, OR (US)

(72) Inventors: Hiromitsu Akiyama, Tokyo (JP); Andrew G. V. Oldknow, Beaverton, OR (US); Robert M. Boyd, Flower Mound, TX (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/734,847

(22) Filed: Jun. 9, 2015

(65) Prior Publication Data

US 2015/0273293 A1 Oct. 1, 2015

Related U.S. Application Data

(63) Continuation of application No. 13/795,881, filed on Mar. 12, 2013, which is a continuation-in-part of
(Continued)

(51) Int. Cl.
*A63B 53/00* (2015.01)
*A63B 53/06* (2015.01)
(Continued)

(52) U.S. Cl.
CPC ..... *A63B 53/06* (2013.01); *A63B 53/04* (2013.01); *A63B 53/0466* (2013.01);
(Continued)

(58) Field of Classification Search
USPC ..... 473/324–350, 305–316; D21/752
See application file for complete search history.

(56) References Cited

U.S. PATENT DOCUMENTS 569,438 A 10/1896 Urquhart
632,885 A 9/1899 Sweny
(Continued)

FOREIGN PATENT DOCUMENTS

CA 2139690 A1 7/1996
CN 2258782 Y 8/1997
(Continued)

OTHER PUBLICATIONS

Aug. 14, 2013—(WO) International Search Report and Written Opinion—App. PCT/US2013/025615.
United States Golf Association; Procedure for Measuring the Flexibility of a Golf Clubhead, USGA-TPX3004; Revision 1.0.0; May 1, 2008; p. 1-11.
Jan. 7, 2010—(WO) International Preliminary Report on Patentability App. PCT/US2008/067499.
May 19, 2009—(WO) International Search Report and Written Opinion App. No. PCT/US2008/067499.
(Continued)

*Primary Examiner* — Gene Kim
*Assistant Examiner* — Matthew B Stanczak
(74) *Attorney, Agent, or Firm* — Banner & Witcoff, Ltd.

(57) ABSTRACT

A ball striking device has a face with a striking surface and a body extending rearwardly from the outer periphery of the face. A channel extends across at least a portion of the sole, and includes a trough defined between front and rear edges and extending in a heel-toe direction. The body further includes a spacing portion that forms a generally flattened surface extending from the front edge to proximate the outer periphery of the face. The rear edge of the channel is spaced rearwardly a different distance from the outer periphery of the face at the center portion of the channel as compared to the heel portion and/or the toe portion. One or more stiffening ribs may also be provided rearwardly of the channel, to increase the stiffness of the sole.

6 Claims, 15 Drawing Sheets

Related U.S. Application Data application No. 13/308,036, filed on Nov. 30, 2011, now Pat. No. 9,089,747.

(60) Provisional application No. 61/653,937, filed on May 31, 2012, provisional application No. 61/418,240, filed on Nov. 30, 2010, provisional application No. 61/541,767, filed on Sep. 30, 2011.

(51) Int. Cl.
*A63B 53/04* (2015.01)
*A63B 60/54* (2015.01)
*A63B 60/52* (2015.01)

(52) U.S. Cl.
CPC ..... *A63B 60/54* (2015.10); *A63B 53/047* (2013.01); *A63B 53/0487* (2013.01); *A63B 60/52* (2015.10); *A63B 2053/045* (2013.01); *A63B 2053/0412* (2013.01); *A63B 2053/0416* (2013.01); *A63B 2053/0433* (2013.01); *A63B 2053/0491* (2013.01); *A63B 2209/02* (2013.01); *A63B 2225/01* (2013.01)

(56) References Cited

U.S. PATENT DOCUMENTS 648,256 A 4/1900 Hartley
651,920 A 6/1900 Cushing, Jr.
670,522 A 3/1901 Thompson
727,086 A 5/1903 Burnam
777,400 A 12/1904 Clark
1,039,491 A 9/1912 Collins
1,058,463 A 4/1913 Pringle
1,083,434 A 1/1914 Curry
1,133,129 A 3/1915 Govan
1,135,621 A 4/1915 Roberts
1,137,457 A 4/1915 Breitenbaugh
1,165,559 A 12/1915 Vories
1,173,384 A 2/1916 Rees
1,190,589 A 7/1916 Rolfe
1,206,104 A 11/1916 Goodrich
1,206,105 A 11/1916 Goodrich
1,219,417 A 3/1917 Vories
1,222,770 A 4/1917 Kaye
1,235,922 A 8/1917 Pittar
1,250,301 A 12/1917 Goodrich
1,258,212 A 3/1918 Goodrich
1,429,569 A 9/1922 Craig
1,529,959 A 3/1925 Martin
1,549,265 A 8/1925 Kaden
1,556,928 A 10/1925 Ganders
1,568,485 A 1/1926 Turney
1,594,850 A 8/1926 Perkins
1,605,140 A 11/1926 Perkins
1,620,588 A 3/1927 Wilson
1,644,177 A 10/1927 Collins
1,676,518 A 7/1928 Boles
1,697,846 A 1/1929 Anderson
1,697,998 A 1/1929 Novak et a1.
1,705,997 A * 3/1929 Quynn ..... 473/329
1,818,359 A 8/1931 Samaras et al.
1,840,924 A 1/1932 Tucker
1,854,548 A * 4/1932 Hunt ..... 473/329
1,916,792 A 7/1933 Hadden
1,974,224 A 9/1934 Van Der Linden
1,993,928 A 3/1935 Glover
2,004,968 A 6/1935 Young
2,041,676 A 5/1936 Gallagher
2,087,685 A 7/1937 Hackney
2,179,034 A 11/1939 Duncan, Jr.
2,217,338 A 10/1940 Fuller
2,242,670 A 5/1941 Fuller
2,305,270 A 12/1942 Nilson
2,329,313 A 9/1943 Winter
2,381,636 A 8/1945 Bancroft
2,384,333 A 9/1945 Nilson
2,429,351 A 10/1947 Fetterolf
2,451,262 A 10/1948 Watkins
2,455,150 A 11/1948 Verderber
2,475,926 A 7/1949 Verderber
2,477,438 A 7/1949 Brouwer
2,495,444 A 1/1950 Chamberlain et al.
2,520,701 A 8/1950 Verderber
2,520,702 A 8/1950 Verderber
2,550,846 A * 5/1951 Milligan ..... 473/327
2,571,970 A 10/1951 Verderber
2,576,866 A 11/1951 Verderber
2,593,368 A 4/1952 Verderber
2,691,525 A 10/1954 Callaghan, Sr.
2,705,147 A 3/1955 Winter
2,750,194 A 6/1956 Clark
2,777,694 A 1/1957 Winter
2,847,219 A 8/1958 Shoemaker et al.
2,962,286 A 11/1960 Brouwer
2,968,486 A 1/1961 Walton
3,045,371 A 7/1962 Kurlinski
3,061,310 A * 10/1962 Giza ..... 473/329
3,064,980 A 11/1962 Steiner
3,084,940 A 4/1963 Cissel
3,166,320 A 1/1965 Onions
3,170,698 A 2/1965 Schoeffler et al.
3,199,873 A 8/1965 Surratt
3,212,783 A 10/1965 Bradley
3,270,564 A 9/1966 Evans
3,292,928 A 12/1966 Billen
3,305,235 A 2/1967 Williams, Jr.
3,477,720 A 11/1969 Saba
3,519,271 A 7/1970 Smith
3,589,731 A 6/1971 Chancellor, Jr.
3,601,399 A 8/1971 Agens et al.
3,606,327 A 9/1971 Gorman
3,753,564 A 8/1973 Brandell
3,788,647 A 1/1974 Evans
3,791,647 A 2/1974 Verderber
3,792,863 A 2/1974 Evans
3,806,131 A 4/1974 Evans
3,810,631 A * 5/1974 Braly ..... 473/328
3,814,437 A 6/1974 Winquist
3,829,102 A 8/1974 Harrison
3,840,231 A 10/1974 Moore
3,931,363 A 1/1976 Giolito et al.
3,931,969 A 1/1976 Townhill
3,945,646 A 3/1976 Hammond
3,966,210 A 6/1976 Rozmus
3,970,236 A 7/1976 Rogers
3,976,299 A 8/1976 Lawrence et al.
3,979,125 A 9/1976 Lancellotti
3,980,301 A 9/1976 Smith
3,997,170 A 12/1976 Goldberg
4,027,885 A 6/1977 Rogers
4,139,196 A 2/1979 Riley
4,165,874 A 8/1979 Lezatte et al.
4,194,739 A 3/1980 Thompson
4,291,883 A 9/1981 Smart et al.
4,313,607 A 2/1982 Thompson
4,322,083 A 3/1982 Imai
4,398,965 A 8/1983 Campau
4,431,192 A 2/1984 Stuff, Jr.
4,438,931 A 3/1984 Motomiya
4,444,392 A 4/1984 Duclos
4,511,145 A 4/1985 Schmidt
4,523,759 A 6/1985 Igarashi
4,534,558 A 8/1985 Yoneyama
4,535,990 A 8/1985 Yamada
4,582,321 A 4/1986 Yoneyama
4,630,827 A 12/1986 Yoneyama
4,632,400 A 12/1986 Boone
4,635,941 A 1/1987 Yoneyama
4,664,383 A 5/1987 Aizawa
4,667,963 A 5/1987 Yoneyama
4,681,321 A 7/1987 Chen et al.
4,697,814 A 10/1987 Yamada
4,708,347 A 11/1987 Kobayashi

(56) References Cited

U.S. PATENT DOCUMENTS 4,728,105 A 3/1988 Kobayashi
4,732,389 A 3/1988 Kobayashi
4,754,974 A 7/1988 Kobayashi
4,811,949 A 3/1989 Kobayashi
4,811,950 A 3/1989 Kobayashi
4,842,280 A 6/1989 Hilton
4,856,782 A 8/1989 Cannan
4,867,458 A 9/1989 Sumikawa et al.
4,871,174 A 10/1989 Kobayashi
4,878,666 A 11/1989 Hosoda
4,895,371 A 1/1990 Bushner
4,898,387 A 2/1990 Finney
4,898,389 A 2/1990 Plutt
4,927,144 A 5/1990 Stormon
4,928,972 A 5/1990 Nakanishi et al.
4,930,781 A 6/1990 Allen
4,940,236 A 7/1990 Allen
4,991,850 A 2/1991 Wilhlem
5,004,242 A 4/1991 Iwanaga et al.
5,009,425 A 4/1991 Okumoto et al.
D318,703 S 7/1991 Shearer
5,028,049 A 7/1991 McKeighen
5,060,951 A 10/1991 Allen
5,067,715 A 11/1991 Schmidt et al.
5,076,585 A 12/1991 Bouquet
D323,035 S 1/1992 Yang
5,078,397 A 1/1992 Aizawa
5,080,366 A 1/1992 Okumoto et al.
5,092,599 A 3/1992 Okumoto et al.
D326,130 S 5/1992 Chorne
5,133,553 A 7/1992 Divnick
5,149,091 A * 9/1992 Okumoto ..... A63B 53/02 273/DIG. 23
5,160,142 A 11/1992 Marshall
5,186,465 A 2/1993 Chorne
5,193,810 A 3/1993 Antonious
5,205,560 A 4/1993 Hoshi et al.
5,211,401 A 5/1993 Hainey
5,213,328 A * 5/1993 Long et al. ..... 473/346
5,221,086 A 6/1993 Antonious
5,221,088 A 6/1993 McTeigue et al.
5,228,689 A 7/1993 Donofrio, Sr.
5,228,694 A 7/1993 Okumoto et al.
5,230,512 A 7/1993 Tattershall
5,233,544 A 8/1993 Kobayashi
5,245,537 A 9/1993 Barber
5,253,869 A 10/1993 Dingle et al.
5,269,517 A 12/1993 Petruccelli et al.
5,282,625 A 2/1994 Schmidt et al.
5,290,036 A 3/1994 Fenton et al.
5,292,123 A 3/1994 Schmidt, Jr. et al.
5,295,689 A 3/1994 Lundberg
5,301,941 A 4/1994 Allen
5,301,946 A 4/1994 Schmidt et al.
5,316,305 A 5/1994 McCabe
5,326,106 A 7/1994 Meyer
5,330,187 A 7/1994 Schmidt et al.
5,332,225 A 7/1994 Ura
D350,176 S * 8/1994 Antonious ..... D21/752
5,333,871 A 8/1994 Wishon
5,340,104 A 8/1994 Griffin
5,346,216 A 9/1994 Aizawa
5,354,063 A 10/1994 Curchod
5,364,093 A 11/1994 Huston et al.
5,372,365 A 12/1994 McTeigue et al.
D354,103 S 1/1995 Allen
5,377,985 A 1/1995 Ohnishi
5,380,010 A 1/1995 Werner et al.
5,385,346 A 1/1995 Carroll et al.
5,393,056 A 2/1995 Richardson
5,407,196 A 4/1995 Busnardo
5,411,263 A * 5/1995 Schmidt ..... A63B 53/0487 473/313
5,413,337 A 5/1995 Goodman et al.
5,413,345 A 5/1995 Nauck
5,419,556 A * 5/1995 Take ..... 473/349
5,419,560 A 5/1995 Bamber
5,429,366 A 7/1995 McCabe
5,433,441 A 7/1995 Olsen et al.
5,435,551 A 7/1995 Chen
5,437,456 A 8/1995 Schmidt et al.
5,441,269 A 8/1995 Henwood
5,447,307 A 9/1995 Antonious
5,451,056 A 9/1995 Manning
5,451,058 A 9/1995 Price et al.
D363,749 S 10/1995 Kenmi
5,464,211 A 11/1995 Atkins, Sr.
5,464,217 A 11/1995 Shenoha et al.
5,467,988 A 11/1995 Henwood
5,472,201 A 12/1995 Aizawa et al.
5,472,203 A 12/1995 Schmidt et al.
5,478,082 A 12/1995 De Knight et al.
D366,508 S 1/1996 Hutin
5,480,152 A 1/1996 Schmidt et al.
5,489,097 A 2/1996 Simmons
5,492,327 A 2/1996 Biafore, Jr.
5,497,995 A 3/1996 Swisshelm
5,505,453 A 4/1996 Mack
5,511,786 A 4/1996 Antonious
5,516,106 A 5/1996 Henwood
5,518,243 A 5/1996 Redman
5,524,081 A 6/1996 Paul
D371,817 S 7/1996 Olsavsky et al.
D372,063 S 7/1996 Hueber
5,531,439 A 7/1996 Azzarella
5,533,725 A 7/1996 Reynolds, Jr.
5,533,728 A * 7/1996 Pehoski et al. ..... 473/252
5,538,245 A 7/1996 Moore
D372,512 S 8/1996 Simmons
5,547,188 A 8/1996 Dumontier et al.
5,547,427 A 8/1996 Rigal et al.
D375,130 S 10/1996 Hlinka et al.
5,564,705 A 10/1996 Kobayashi et al.
D375,987 S 11/1996 Lin
5,570,886 A 11/1996 Rigal et al.
5,580,058 A 12/1996 Coughlin
5,581,993 A 12/1996 Strobel
5,584,770 A 12/1996 Jensen
5,586,947 A 12/1996 Hutin
5,586,948 A 12/1996 Mick
D377,509 S 1/1997 Katayama
5,595,552 A 1/1997 Wright et al.
5,601,498 A 2/1997 Antonious
5,603,668 A * 2/1997 Antonious ..... 473/328
5,607,365 A 3/1997 Wolf
5,611,740 A 3/1997 Nagamoto
D378,770 S 4/1997 Hlinka et al.
5,616,088 A 4/1997 Aizawa et al.
5,616,832 A 4/1997 Nauck
5,626,528 A 5/1997 Toulon
5,626,530 A 5/1997 Schmidt et al.
5,632,695 A 5/1997 Hlinka et al.
5,634,855 A 6/1997 King
D381,382 S 7/1997 Fenton, Jr.
D382,612 S 8/1997 Oyer
5,669,829 A 9/1997 Lin
5,681,993 A 10/1997 Heitman
D386,550 S 11/1997 Wright et al.
D386,551 S 11/1997 Solheim et al.
D387,113 S 12/1997 Burrows
D387,405 S 12/1997 Solheim et al.
5,692,968 A 12/1997 Shine
5,692,972 A 12/1997 Langslet
5,695,409 A 12/1997 Jackson
5,709,613 A 1/1998 Sheraw
5,709,615 A 1/1998 Liang
5,711,722 A 1/1998 Miyajima et al.
5,718,301 A 2/1998 Williams
5,718,641 A 2/1998 Lin
D392,007 S 3/1998 Fox
5,724,265 A 3/1998 Hutchings
5,728,006 A 3/1998 Teitell et al.
5,735,754 A * 4/1998 Antonious ..... 473/328
D394,688 S 5/1998 Fox

(56) References Cited

U.S. PATENT DOCUMENTS 5,746,664 A 5/1998 Reynolds, Jr.
5,749,795 A 5/1998 Schmidt et al.
5,755,625 A 5/1998 Jackson
5,766,094 A 6/1998 Mahaffey et al.
5,772,525 A 6/1998 Klein
5,772,527 A 6/1998 Liu
5,779,555 A 7/1998 Nomura et al.
5,785,609 A 7/1998 Sheets et al.
D397,387 S 8/1998 Allen
5,788,584 A 8/1998 Parente et al.
5,792,000 A 8/1998 Weber et al.
5,792,001 A 8/1998 Henwood
D397,750 S 9/1998 Frazetta
D398,687 S 9/1998 Miyajima et al.
D398,946 S 9/1998 Kenmi
5,803,829 A 9/1998 Hayashi
5,803,830 A 9/1998 Austin et al.
D399,274 S 10/1998 Bradford
5,820,481 A 10/1998 Raudman
5,826,874 A 10/1998 Teitell et al.
D400,945 S 11/1998 Gilbert et al.
5,839,975 A 11/1998 Lundberg
D403,037 S 12/1998 Stone et al.
5,863,261 A 1/1999 Eggiman
D405,488 S 2/1999 Burrows
5,873,791 A 2/1999 Allen
5,888,148 A 3/1999 Allen
5,908,356 A 6/1999 Nagamoto
5,908,357 A 6/1999 Hsieh
5,928,087 A 7/1999 Emberton et al.
5,941,782 A 8/1999 Cook
D413,952 S 9/1999 Oyer
D414,234 S 9/1999 Darrah
5,947,841 A 9/1999 Silvestro
5,951,410 A 9/1999 Butler et al.
5,955,667 A 9/1999 Fyfe
5,971,868 A 10/1999 Kosmatka
5,973,596 A 10/1999 French et al.
5,993,329 A 11/1999 Shieh
5,997,415 A 12/1999 Wood
6,001,028 A 12/1999 Tang et al.
6,001,030 A 12/1999 Delaney
6,007,432 A 12/1999 Kosmatka
6,012,988 A 1/2000 Burke
6,015,354 A 1/2000 Ahn et al.
6,018,705 A 1/2000 Gaudet et al.
D422,041 S 3/2000 Bradford
6,042,486 A 3/2000 Gallagher
6,044,704 A 4/2000 Sacher
6,045,364 A 4/2000 Dugan et al.
6,048,278 A 4/2000 Meyer et al.
6,052,654 A 4/2000 Gaudet et al.
6,074,308 A 6/2000 Domas
6,074,309 A 6/2000 Mahaffey
6,080,068 A 6/2000 Takeda
6,086,485 A 7/2000 Hamada et al.
6,095,931 A 8/2000 Hettinger et al.
6,117,022 A 9/2000 Crawford et al.
6,120,384 A 9/2000 Drake
6,123,627 A 9/2000 Antonious
6,149,533 A 11/2000 Finn
6,149,534 A 11/2000 Peters et al.
6,159,109 A 12/2000 Langslet
6,176,791 B1 1/2001 Wright
6,193,614 B1 2/2001 Sasamoto et al.
6,196,932 B1 3/2001 Marsh et al.
6,203,449 B1 3/2001 Kenmi
6,206,788 B1 3/2001 Krenzler
6,217,461 B1 4/2001 Galy
6,224,493 B1 5/2001 Lee et al.
6,248,021 B1 6/2001 Ognjanovic
6,261,102 B1 7/2001 Dugan et al.
6,270,422 B1 8/2001 Fisher
6,270,423 B1 8/2001 Webb
6,299,546 B1 10/2001 Wang
6,299,553 B1 10/2001 Petuchowski et al.
6,302,807 B1 10/2001 Rohrer
6,319,149 B1 11/2001 Lee
6,319,150 B1 * 11/2001 Werner et al. ..... 473/349
6,332,848 B1 12/2001 Long et al.
6,338,683 B1 1/2002 Kosmatka
6,342,018 B1 1/2002 Mason
6,344,000 B1 2/2002 Hamada et al.
6,344,001 B1 2/2002 Hamada et al.
6,348,009 B1 2/2002 Dischler
6,348,013 B1 * 2/2002 Kosmatka ..... 473/329
6,354,956 B1 3/2002 Doong
6,354,961 B1 3/2002 Allen
RE37,647 E 4/2002 Wolf
6,368,232 B1 4/2002 Hamada et al.
6,368,234 B1 4/2002 Galloway
6,386,987 B1 5/2002 Lejeune, Jr.
6,390,932 B1 5/2002 Kosmatka et al.
6,390,933 B1 * 5/2002 Galloway ..... A63B 53/02 473/290
6,394,910 B1 5/2002 McCarthy
6,402,634 B2 6/2002 Lee et al.
6,402,637 B1 6/2002 Sasamoto et al.
6,402,638 B1 6/2002 Kelley
6,413,167 B1 7/2002 Burke
6,422,951 B1 7/2002 Burrows
6,428,423 B1 8/2002 Merko
6,430,843 B1 8/2002 Potter et al.
6,431,990 B1 8/2002 Manwaring
6,435,982 B1 8/2002 Galloway et al.
6,441,745 B1 8/2002 Gates
6,443,857 B1 9/2002 Chuang
6,447,405 B1 9/2002 Chen
6,454,665 B2 9/2002 Antonious
6,456,938 B1 9/2002 Barnard
6,471,603 B1 10/2002 Kosmatka
D465,251 S 11/2002 Wood et al.
6,475,100 B1 * 11/2002 Helmstetter ..... A63B 53/02 473/309
6,478,690 B2 11/2002 Helmstetter et al.
6,482,107 B1 11/2002 Urbanski et al.
6,506,126 B1 1/2003 Goodman
6,506,129 B2 1/2003 Chen
6,514,154 B1 2/2003 Finn
6,524,194 B2 2/2003 McCabe
6,524,197 B2 2/2003 Boone
6,524,198 B2 2/2003 Takeda
6,530,847 B1 3/2003 Antonious
6,533,679 B1 3/2003 McCabe et al.
6,551,199 B2 4/2003 Viera
6,558,268 B2 5/2003 Tindale
6,558,271 B1 5/2003 Beach et al.
6,561,917 B2 5/2003 Manwaring
6,575,854 B1 6/2003 Yang et al.
6,602,149 B1 8/2003 Jacobson
6,605,007 B1 8/2003 Bissonnette et al.
6,607,450 B1 8/2003 Hackman
6,607,451 B2 8/2003 Kosmatka et al.
6,616,547 B2 9/2003 Vincent et al.
6,634,956 B1 10/2003 Pegg
6,638,175 B2 10/2003 Lee et al.
D482,089 S 11/2003 Burrows
D482,090 S 11/2003 Burrows
D482,420 S 11/2003 Burrows
6,641,490 B2 11/2003 Ellemor
6,648,769 B2 11/2003 Lee et al.
6,652,390 B2 11/2003 Bradford
6,652,391 B1 11/2003 Kubica et al.
D484,208 S 12/2003 Burrows
6,663,503 B1 12/2003 Kenmi
6,663,506 B2 12/2003 Nishimoto et al.
6,676,533 B1 1/2004 Hsien
6,679,786 B2 1/2004 McCabe
D486,542 S 2/2004 Burrows
6,688,989 B2 2/2004 Best
6,695,715 B1 2/2004 Chikaraishi
6,697,820 B1 2/2004 Tarlie
6,719,641 B2 4/2004 Dabbs et al.
6,719,645 B2 4/2004 Kouno

(56) References Cited

U.S. PATENT DOCUMENTS 6,739,983 B2 5/2004 Helmstetter et al.
6,743,112 B2 6/2004 Nelson
6,743,118 B1 6/2004 Soracco
6,757,572 B1 6/2004 Forest
6,767,292 B1 7/2004 Skalla, Sr.
6,773,360 B2 8/2004 Willett et al.
6,780,123 B2 8/2004 Hasebe
6,783,465 B2 8/2004 Matsunaga
6,800,037 B2 10/2004 Kosmatka
6,800,038 B2 10/2004 Willett et al.
6,800,039 B1 10/2004 Tseng
6,802,772 B1 10/2004 Kunzle et al.
D498,508 S 11/2004 Antonious
6,811,496 B2 11/2004 Wahl et al.
6,819,247 B2 11/2004 Birnbach et al.
6,821,209 B2 11/2004 Manwaring et al.
D501,036 S 1/2005 Burrows
6,837,800 B2 1/2005 Rollinson et al.
6,840,872 B2 1/2005 Yoneyama
D501,523 S 2/2005 Dogan et al.
D501,903 S 2/2005 Tanaka
D502,232 S * 2/2005 Antonious ..... D21/733
6,855,068 B2 2/2005 Antonious
6,863,620 B2 3/2005 Tucker, Sr.
D504,478 S 4/2005 Burrows
6,876,947 B1 4/2005 Darley et al.
6,878,071 B1 4/2005 Schwieger et al.
6,882,955 B1 4/2005 Ohlenbusch et al.
6,887,165 B2 * 5/2005 Tsurumaki ..... 473/344
6,899,638 B2 5/2005 Iwata et al.
6,900,759 B1 5/2005 Katayama
D506,236 S 6/2005 Evans et al.
D508,274 S 8/2005 Burrows
6,923,729 B2 8/2005 McGinty et al.
6,923,733 B2 8/2005 Chen
6,926,618 B2 8/2005 Sanchez et al.
6,929,558 B2 8/2005 Manwaring et al.
6,960,142 B2 11/2005 Bissonnette et al.
6,979,270 B1 12/2005 Allen
6,991,552 B2 1/2006 Burke
6,991,555 B2 1/2006 Reese
6,991,560 B2 1/2006 Tseng
D515,642 S * 2/2006 Antonious ..... D21/733
6,994,635 B2 2/2006 Poynor
7,004,848 B2 2/2006 Konow
7,018,303 B2 3/2006 Yamamoto
7,018,304 B2 3/2006 Bradford
7,021,140 B2 4/2006 Perkins
7,025,692 B2 * 4/2006 Erickson et al. ..... 473/335
D520,585 S 5/2006 Hasebe
7,037,198 B2 5/2006 Hameen-Anttila
7,041,003 B2 5/2006 Bissonnette et al.
7,041,014 B2 5/2006 Wright et al.
7,048,646 B2 5/2006 Yamanaka et al.
D523,104 S 6/2006 Hasebe
D523,498 S 6/2006 Chen et al.
7,056,229 B2 6/2006 Chen
7,066,835 B2 * 6/2006 Evans et al. ..... 473/346
D524,392 S 7/2006 Madore et al.
7,070,513 B2 7/2006 Takeda et al.
7,070,515 B1 7/2006 Liu
7,077,757 B1 7/2006 Payne et al.
7,083,530 B2 8/2006 Wahl et al.
7,086,964 B2 8/2006 Chen et al.
7,090,590 B2 8/2006 Chen
7,097,572 B2 8/2006 Yabu
7,118,498 B2 10/2006 Meadows et al.
7,121,956 B2 10/2006 Lo
7,121,962 B2 10/2006 Reeves
7,125,340 B1 10/2006 Priester et al.
7,128,660 B2 10/2006 Gillig
7,128,663 B2 10/2006 Bamber
7,134,971 B2 11/2006 Franklin et al.
7,137,907 B2 11/2006 Gibbs et al.
7,140,974 B2 11/2006 Chao et al.
7,140,975 B2 11/2006 Bissonnette et al.
7,140,977 B2 11/2006 Atkins, Sr.
7,147,569 B2 12/2006 Tang et al.
7,156,750 B2 1/2007 Nishitani et al.
7,160,200 B2 1/2007 Grober
7,163,468 B2 1/2007 Gibbs et al.
7,163,470 B2 1/2007 Galloway et al.
7,166,041 B2 1/2007 Evans
7,169,059 B2 1/2007 Rice et al.
D536,402 S 2/2007 Kawami
7,175,177 B2 2/2007 Meifu et al.
7,175,511 B2 2/2007 Ueda et al.
7,175,541 B2 2/2007 Lo
7,186,185 B2 3/2007 Nagy
7,186,188 B2 3/2007 Gilbert et al.
7,192,364 B2 3/2007 Long
7,201,668 B1 4/2007 Pamias
7,207,898 B2 4/2007 Rice et al.
7,211,006 B2 5/2007 Chang
7,214,138 B1 5/2007 Stivers et al.
7,226,362 B1 6/2007 Schell et al.
7,226,366 B2 6/2007 Galloway
7,234,351 B2 6/2007 Perkins
7,235,020 B1 6/2007 Christensen
7,241,230 B2 7/2007 Tsunoda
7,244,189 B1 7/2007 Stobbe
7,247,104 B2 7/2007 Poynor
7,255,653 B2 8/2007 Saso
7,258,631 B2 8/2007 Galloway et al.
7,261,643 B2 8/2007 Rice et al.
D551,310 S 9/2007 Kuan et al.
7,264,554 B2 9/2007 Bentley
7,264,555 B2 9/2007 Lee et al.
D552,701 S 10/2007 Ruggiero et al.
7,278,926 B2 10/2007 Frame
7,281,985 B2 10/2007 Galloway
7,294,064 B2 * 11/2007 Tsurumaki et al. ..... 473/329
7,297,071 B2 11/2007 Hyman
7,297,073 B2 11/2007 Jung
7,310,895 B2 12/2007 Whittlesey et al.
7,318,782 B2 1/2008 Imamoto et al.
7,326,121 B2 2/2008 Roake
7,335,112 B1 2/2008 Bitondo
7,344,452 B2 3/2008 Imamoto et al.
7,347,795 B2 3/2008 Yamagishi et al.
D566,214 S 4/2008 Evans et al.
7,351,157 B2 4/2008 Priester et al.
7,351,161 B2 4/2008 Beach
7,367,898 B2 5/2008 Hawkins et al.
7,371,184 B2 5/2008 Tao
7,387,579 B2 6/2008 Lin et al.
7,396,289 B2 7/2008 Soracco et al.
7,396,293 B2 7/2008 Soracco
7,396,296 B2 7/2008 Evans
7,407,443 B2 8/2008 Franklin et al.
7,419,439 B1 9/2008 Aleamoni
7,431,660 B2 10/2008 Hasegawa
7,431,663 B2 10/2008 Pamias
7,435,189 B2 10/2008 Hirano
7,438,649 B2 10/2008 Ezaki et al.
7,442,132 B2 10/2008 Nishio
7,445,563 B1 11/2008 Werner
7,470,201 B2 12/2008 Nakahara et al.
7,473,186 B2 1/2009 Best et al.
7,476,161 B2 1/2009 Williams et al.
7,494,426 B2 2/2009 Nishio et al.
D588,223 S 3/2009 Kuan
7,500,924 B2 * 3/2009 Yokota ..... 473/332
7,509,842 B2 3/2009 Kostuj
7,520,820 B2 4/2009 Dimarco
7,530,901 B2 * 5/2009 Imamoto et al. ..... 473/334
7,530,903 B2 5/2009 Imamoto et al.
7,540,810 B2 6/2009 Hettinger et al.
7,559,850 B2 7/2009 Gilbert et al.
7,563,176 B2 7/2009 Roberts et al.
7,572,193 B2 * 8/2009 Yokota ..... 473/328
7,575,523 B2 8/2009 Yokota
7,575,524 B2 8/2009 Willett et al.
7,582,024 B2 9/2009 Shear

(56) References Cited

U.S. PATENT DOCUMENTS 7,585,233 B2 9/2009 Horacek et al.
7,602,301 B1 10/2009 Stirling et al.
7,618,331 B2 11/2009 Hirano
7,621,820 B2 11/2009 Clausen et al.
7,627,451 B2 12/2009 Vock et al.
7,632,193 B2 12/2009 Thielen
7,641,568 B2 1/2010 Hoffman et al.
7,641,569 B2 1/2010 Best et al.
7,647,071 B2 1/2010 Rofougaran et al.
7,651,409 B1 1/2010 Mier
7,682,264 B2 3/2010 Hsu et al.
D613,357 S 4/2010 Utz
7,691,004 B1 4/2010 Lueders
7,713,138 B2 5/2010 Sato et al.
7,717,803 B2 5/2010 DiMarco
7,717,807 B2 * 5/2010 Evans et al. ..... 473/345
7,722,478 B2 5/2010 Ebner
D616,952 S 6/2010 Oldknow
7,736,242 B2 6/2010 Stites et al.
D619,666 S 7/2010 DePaul
7,749,101 B2 7/2010 Imamoto et al.
7,753,809 B2 7/2010 Cackett et al.
7,758,452 B2 7/2010 Soracco
7,766,760 B2 8/2010 Priester et al.
7,771,263 B2 8/2010 Telford
7,771,285 B2 8/2010 Porter
7,771,290 B2 8/2010 Bezilla et al.
7,780,535 B2 8/2010 Hagood et al.
7,789,742 B1 9/2010 Murdock et al.
7,800,480 B1 9/2010 Joseph et al.
7,801,575 B1 9/2010 Balardeta et al.
7,803,066 B2 9/2010 Solheim et al.
7,804,404 B1 9/2010 Balardeta et al.
7,811,182 B2 10/2010 Ligotti, III et al.
7,821,407 B2 10/2010 Shears et al.
7,824,277 B2 11/2010 Bennett et al.
7,825,815 B2 11/2010 Shears et al.
7,831,212 B1 11/2010 Balardeta et al.
7,837,574 B2 11/2010 Brunner
7,837,575 B2 11/2010 Lee et al.
7,837,577 B2 11/2010 Evans
7,846,036 B2 12/2010 Tanaka
7,853,211 B1 12/2010 Balardeta et al.
7,857,705 B1 12/2010 Galloway
7,857,711 B2 12/2010 Shear
7,867,105 B2 1/2011 Moon
7,871,336 B2 1/2011 Breier et al.
7,878,924 B2 2/2011 Clausen et al.
7,881,499 B2 2/2011 Bissonnette et al.
7,883,428 B1 2/2011 Balardeta et al.
7,887,440 B2 2/2011 Wright et al.
7,892,102 B1 2/2011 Galloway
7,896,753 B2 3/2011 Boyd et al.
7,918,745 B2 4/2011 Morris et al.
7,922,596 B2 4/2011 Vanderbilt et al.
7,922,603 B2 4/2011 Boyd et al.
7,927,231 B2 4/2011 Sato et al.
7,931,545 B2 4/2011 Soracco et al.
7,934,998 B2 * 5/2011 Yokota ..... 473/227
7,934,999 B2 5/2011 Cackett et al.
7,935,003 B2 5/2011 Matsunaga et al.
7,938,739 B2 5/2011 Cole et al.
7,941,097 B1 5/2011 Balardeta et al.
7,946,926 B1 5/2011 Balardeta et al.
7,957,767 B2 6/2011 Rofougaran
7,959,519 B2 6/2011 Zielke et al.
7,959,523 B2 6/2011 Rae et al.
7,967,699 B2 6/2011 Soracco
7,978,081 B2 7/2011 Shears et al.
7,988,565 B2 * 8/2011 Abe ..... 473/328
7,993,211 B2 8/2011 Bardha
7,993,213 B1 8/2011 D'Eath
7,997,999 B2 8/2011 Roach et al.
8,007,371 B2 8/2011 Breier et al.
8,012,041 B2 9/2011 Gibbs et al.
8,016,694 B2 9/2011 Llewellyn et al.
8,025,586 B2 9/2011 Teramoto
8,043,166 B2 10/2011 Cackett et al.
8,052,539 B2 11/2011 Kimber
8,070,622 B2 12/2011 Schmidt
8,074,495 B2 12/2011 Kostuj
8,092,316 B2 1/2012 Breier et al.
8,100,779 B2 1/2012 Solheim et al.
8,105,175 B2 1/2012 Breier et al.
8,117,903 B2 2/2012 Golden et al.
D659,781 S * 5/2012 Oldknow ..... D21/752
8,172,697 B2 * 5/2012 Cackett et al. ..... 473/329
8,177,661 B2 5/2012 Beach et al.
8,177,664 B2 5/2012 Horii et al.
8,182,364 B2 5/2012 Cole et al.
8,187,116 B2 5/2012 Boyd et al.
8,206,241 B2 6/2012 Boyd et al.
8,210,961 B2 7/2012 Finn et al.
8,226,495 B2 7/2012 Savarese et al.
D665,472 S * 8/2012 McDonnell ..... D21/759
8,235,841 B2 * 8/2012 Stites et al. ..... 473/328
8,235,844 B2 * 8/2012 Albertsen et al. ..... 473/345
8,241,143 B2 8/2012 Albertsen et al.
8,241,144 B2 8/2012 Albertsen et al.
8,251,834 B2 8/2012 Curtis et al.
8,251,836 B2 8/2012 Brandt
8,257,195 B1 9/2012 Erickson
8,257,196 B1 * 9/2012 Abbott et al. ..... 473/335
8,272,974 B2 9/2012 Mickelson et al.
8,277,337 B2 10/2012 Shimazaki
8,282,506 B1 10/2012 Holt
8,303,434 B1 11/2012 DePaul
8,308,583 B2 11/2012 Morris et al.
8,328,659 B2 12/2012 Shear
8,330,284 B2 12/2012 Weston et al.
8,333,668 B2 12/2012 De La Cruz et al.
8,337,319 B2 * 12/2012 Sargent ..... A63B 53/02 473/246
8,337,325 B2 12/2012 Boyd et al.
8,337,335 B2 12/2012 Dugan
8,342,978 B2 1/2013 Tamura
8,353,782 B1 1/2013 Beach et al.
8,353,786 B2 1/2013 Beach et al.
D675,691 S 2/2013 Oldknow et al.
D675,692 S 2/2013 Oldknow et al.
D676,512 S 2/2013 Oldknow et al.
D676,909 S 2/2013 Oldknow et al.
D676,913 S 2/2013 Oldknow et al.
D676,914 S 2/2013 Oldknow et al.
D676,915 S 2/2013 Oldknow et al.
8,382,604 B2 2/2013 Billings
D677,353 S 3/2013 Oldknow et al.
D678,913 S 3/2013 Chu
D678,964 S 3/2013 Oldknow et al.
D678,965 S 3/2013 Oldknow et al.
D678,968 S 3/2013 Oldknow et al.
D678,969 S 3/2013 Oldknow et al.
D678,970 S 3/2013 Oldknow et al.
D678,971 S 3/2013 Oldknow et al.
D678,972 S 3/2013 Oldknow et al.
D678,973 S 3/2013 Oldknow et al.
8,403,771 B1 * 3/2013 Rice et al. ..... 473/328
D679,354 S 4/2013 Oldknow et al.
8,430,763 B2 * 4/2013 Beach et al. ..... 473/307
8,430,764 B2 4/2013 Bennett et al.
8,430,770 B2 4/2013 Dugan
8,435,134 B2 * 5/2013 Tang et al. ..... 473/329
8,435,135 B2 5/2013 Stites et al.
D684,230 S * 6/2013 Roberts ..... D21/752
8,491,416 B1 * 7/2013 Demille et al. ..... 473/346
8,517,851 B2 8/2013 Cackett et al.
8,517,855 B2 8/2013 Beach et al.
8,517,860 B2 8/2013 Albertsen et al.
8,529,368 B2 9/2013 Rice et al.
8,535,171 B2 9/2013 McGinnis, Jr.
8,562,453 B2 10/2013 Sato
8,579,728 B2 * 11/2013 Morales et al. ..... 473/349
8,591,351 B2 11/2013 Albertsen et al.
8,591,352 B2 11/2013 Hirano

(56) References Cited

U.S. PATENT DOCUMENTS 8,591,353 B1 11/2013 Honea et al.
8,593,286 B2 11/2013 Razoumov et al.
8,608,587 B2 12/2013 Henrikson et al.
D697,152 S * 1/2014 Harbert ..... D21/752
8,628,433 B2 1/2014 Stites et al.
8,632,419 B2 1/2014 Tang et al.
8,641,555 B2 2/2014 Stites et al.
8,663,027 B2 3/2014 Morales et al.
8,690,704 B2 * 4/2014 Thomas ..... 473/327
8,696,450 B2 4/2014 Rose et al.
8,696,491 B1 * 4/2014 Myers ..... 473/334
8,702,531 B2 * 4/2014 Boyd et al. ..... 473/305
8,715,096 B2 5/2014 Cherbini
8,734,265 B2 5/2014 Soracco
D707,768 S 6/2014 Oldknow et al.
D707,769 S 6/2014 Oldknow et al.
D707,773 S 6/2014 Oldknow et al.
8,758,153 B2 * 6/2014 Sargent ..... A63B 53/02 473/246
D708,281 S 7/2014 Oldknow et al.
D709,575 S 7/2014 Oldknow et al.
8,784,228 B2 7/2014 Morin et al.
8,801,532 B2 8/2014 Katayama
8,821,312 B2 * 9/2014 Burnett et al. ..... 473/329
8,827,831 B2 * 9/2014 Burnett et al. ..... 473/329
8,827,836 B2 * 9/2014 Thomas ..... 473/345
8,834,289 B2 * 9/2014 de la Cruz et al. ..... 473/329
8,834,290 B2 * 9/2014 Bezilla et al. ..... 473/329
8,840,483 B1 9/2014 Steusloff et al.
8,845,454 B2 9/2014 Boyd et al.
D714,893 S 10/2014 Atwell
8,858,360 B2 * 10/2014 Rice et al. ..... 473/329
8,870,679 B2 * 10/2014 Oldknow ..... 473/344
8,888,607 B2 * 11/2014 Harbert ..... A63B 53/04 473/307
8,941,723 B2 1/2015 Bentley et al.
D722,122 S 2/2015 Greensmith
D725,729 S * 3/2015 Song ..... D21/752
8,986,133 B2 * 3/2015 Bennett et al. ..... 473/329
8,994,826 B2 3/2015 Bentley
D726,847 S * 4/2015 Song ..... D21/752
9,072,948 B2 7/2015 Franklin et al.
9,089,747 B2 7/2015 Boyd et al.
9,101,805 B2 8/2015 Stites et al.
9,101,808 B2 8/2015 Stites et al.
2001/0005695 A1 6/2001 Lee et al.
2001/0035880 A1 11/2001 Musatov et al.
2001/0041628 A1 11/2001 Thorne et al.
2001/0053720 A1 12/2001 Lee et al.
2002/0004723 A1 1/2002 Meifu et al.
2002/0019265 A1 2/2002 Allen
2002/0019677 A1 2/2002 Lee
2002/0049507 A1 4/2002 Hameen-Anttila
2002/0052246 A1 5/2002 Burke
2002/0052750 A1 5/2002 Hirooka
2002/0055396 A1 5/2002 Nishimoto et al.
2002/0072815 A1 6/2002 McDonough et al.
2002/0077189 A1 6/2002 Tuer et al.
2002/0082775 A1 6/2002 Meadows et al.
2002/0107085 A1 8/2002 Lee et al.
2002/0123386 A1 9/2002 Perlmutter
2002/0137576 A1 9/2002 Dammen
2002/0151994 A1 10/2002 Sisco
2002/0160848 A1 10/2002 Burke
2002/0173364 A1 11/2002 Boscha
2002/0173365 A1 11/2002 Boscha
2002/0183134 A1 12/2002 Allen et al.
2002/0183657 A1 12/2002 Socci et al.
2002/0189356 A1 12/2002 Bissonnette et al.
2003/0008722 A1 1/2003 Konow
2003/0009913 A1 1/2003 Potter et al.
2003/0013545 A1 1/2003 Vincent et al.
2003/0014134 A1 1/2003 Morgan
2003/0036436 A1 2/2003 Casanova et al.
2003/0040380 A1 2/2003 Wright et al.
2003/0045371 A1 3/2003 Wood et al.
2003/0054900 A1 3/2003 Tindale
2003/0130059 A1 7/2003 Billings
2003/0132844 A1 7/2003 Walker
2003/0190975 A1 10/2003 Fagot
2003/0191547 A1 10/2003 Morse
2003/0207718 A1 11/2003 Perlmutter
2003/0220154 A1 11/2003 Anelli
2004/0009829 A1 1/2004 Kapilow
2004/0018890 A1 1/2004 Stites et al.
2004/0023729 A1 2/2004 Nagai et al.
2004/0067797 A1 4/2004 Knecht
2004/0106460 A1 6/2004 Lee et al.
2004/0121852 A1 6/2004 Tsurumaki
2004/0132541 A1 7/2004 MacIlraith
2004/0142603 A1 7/2004 Walker
2004/0176183 A1 9/2004 Tsurumaki
2004/0177531 A1 9/2004 DiBenedetto et al.
2004/0180730 A1 9/2004 Franklin et al.
2004/0192463 A1 9/2004 Tsurumaki et al.
2004/0204257 A1 10/2004 Boscha et al.
2004/0219991 A1 11/2004 Suprock et al.
2004/0225199 A1 11/2004 Evanyk et al.
2004/0229707 A1 11/2004 Lin
2004/0259651 A1 12/2004 Storek
2005/0009630 A1 1/2005 Chao et al.
2005/0017454 A1 1/2005 Endo et al.
2005/0032582 A1 2/2005 Mahajan et al.
2005/0032586 A1 2/2005 Willett et al.
2005/0037862 A1 2/2005 Hagood et al.
2005/0043109 A1 2/2005 Buckley et al.
2005/0049075 A1 3/2005 Chen et al.
2005/0049081 A1 3/2005 Boone
2005/0054457 A1 3/2005 Eyestone et al.
2005/0070371 A1 3/2005 Chen et al.
2005/0079922 A1 4/2005 Priester et al.
2005/0096151 A1 5/2005 Hou et al.
2005/0096761 A1 5/2005 Hanover et al.
2005/0101407 A1 5/2005 Hirano
2005/0119068 A1 6/2005 Onoda et al.
2005/0119070 A1 6/2005 Kumamoto
2005/0124435 A1 6/2005 Gambetta et al.
2005/0137024 A1 6/2005 Stites et al.
2005/0188566 A1 9/2005 Whittlesey et al.
2005/0192118 A1 9/2005 Rice et al.
2005/0215340 A1 9/2005 Stites et al.
2005/0215350 A1 9/2005 Reyes et al.
2005/0227775 A1 10/2005 Cassady et al.
2005/0227780 A1 10/2005 Cover et al.
2005/0227781 A1 10/2005 Huang et al.
2005/0240294 A1 10/2005 Jones et al.
2005/0261073 A1 11/2005 Farrington et al.
2005/0266933 A1 12/2005 Galloway
2005/0282650 A1 12/2005 Miettinen et al.
2005/0288119 A1 12/2005 Wang et al.
2006/0000528 A1 1/2006 Galloway
2006/0019770 A1 1/2006 Meyer et al.
2006/0025229 A1 2/2006 Mahajan et al.
2006/0029916 A1 2/2006 Boscha
2006/0035718 A1 2/2006 Soracco et al.
2006/0040757 A1 2/2006 Rosselli
2006/0040765 A1 2/2006 Sano
2006/0046868 A1 3/2006 Murphy
2006/0052173 A1 3/2006 Telford
2006/0063600 A1 3/2006 Grober
2006/0068932 A1 3/2006 Rice et al.
2006/0073908 A1 4/2006 Tavares et al.
2006/0073910 A1 4/2006 Imamoto et al.
2006/0079349 A1 4/2006 Rae et al.
2006/0084516 A1 4/2006 Eyestone et al.
2006/0084525 A1 4/2006 Imamoto et al.
2006/0089845 A1 4/2006 Marcell et al.
2006/0090549 A1 5/2006 Kostuj
2006/0094520 A1 5/2006 Kostuj
2006/0094524 A1 5/2006 Kostuj
2006/0094531 A1 5/2006 Bissonnette et al.
2006/0105849 A1 5/2006 Brunner
2006/0105853 A1 5/2006 Glass
2006/0105857 A1 5/2006 Stark

(56) References Cited

U.S. PATENT DOCUMENTS

2006/0109116 A1 5/2006 Keays
2006/0111201 A1 5/2006 Nishio et al.
2006/0122002 A1 6/2006 Konow
2006/0122004 A1* 6/2006 Chen et al. ..... 473/335
2006/0166737 A1 7/2006 Bentley
2006/0166738 A1 7/2006 Eyestone et al.
2006/0183564 A1 8/2006 Park
2006/0184336 A1 8/2006 Kolen
2006/0189407 A1 8/2006 Soracco
2006/0194178 A1 8/2006 Goldstein
2006/0194644 A1 8/2006 Nishio
2006/0199659 A1 9/2006 Caldwell
2006/0224306 A1 10/2006 Workman et al.
2006/0240908 A1 10/2006 Adams et al.
2006/0276256 A1 12/2006 Storek
2006/0281582 A1 12/2006 Sugimoto
2006/0287118 A1 12/2006 Wright et al.
2007/0006489 A1 1/2007 Case et al.
2007/0010341 A1 1/2007 Miettinen et al.
2007/0011919 A1 1/2007 Case
2007/0015601 A1 1/2007 Tsunoda et al.
2007/0021234 A1 1/2007 Tsurumaki et al.
2007/0026961 A1 2/2007 Hou
2007/0049400 A1 3/2007 Imamoto et al.
2007/0049407 A1 3/2007 Tateno et al.
2007/0049415 A1 3/2007 Shear
2007/0049417 A1 3/2007 Shear
2007/0082751 A1 4/2007 Lo et al.
2007/0087866 A1 4/2007 Meadows et al.
2007/0111811 A1 5/2007 Grober
2007/0117648 A1 5/2007 Yokota
2007/0129178 A1 6/2007 Reeves
2007/0135225 A1 6/2007 Nieminen et al.
2007/0135237 A1 6/2007 Reeves
2007/0149309 A1 6/2007 Ford
2007/0155538 A1 7/2007 Rice et al.
2007/0191126 A1 8/2007 Mandracken
2007/0225085 A1 9/2007 Koide et al.
2007/0238538 A1 10/2007 Priester
2007/0238551 A1 10/2007 Yokota
2007/0270214 A1 11/2007 Bentley
2008/0009360 A1 1/2008 Purtill
2008/0015047 A1 1/2008 Rice et al.
2008/0032817 A1 2/2008 Lo
2008/0039222 A1 2/2008 Kiraly
2008/0039228 A1 2/2008 Breier et al.
2008/0051208 A1 2/2008 Lee et al.
2008/0064523 A1 3/2008 Chen
2008/0076580 A1 3/2008 Murdock et al.
2008/0085778 A1 4/2008 Dugan
2008/0085788 A1 4/2008 Rainer et al.
2008/0119303 A1 5/2008 Bennett et al.
2008/0125239 A1 5/2008 Clausen et al.
2008/0125244 A1 5/2008 Meyer et al.
2008/0125246 A1 5/2008 Matsunaga
2008/0125288 A1 5/2008 Case
2008/0139339 A1 6/2008 Cheng
2008/0146370 A1 6/2008 Beach et al.
2008/0171610 A1 7/2008 Shin
2008/0182682 A1 7/2008 Rice et al.
2008/0188310 A1 8/2008 Murdock
2008/0200275 A1 8/2008 Wagen et al.
2008/0218343 A1 9/2008 Lee et al.
2008/0242354 A1 10/2008 Rofougaran
2008/0248896 A1 10/2008 Hirano
2008/0287205 A1 11/2008 Katayama
2008/0318703 A1 12/2008 Mooney
2009/0018795 A1 1/2009 Priester et al.
2009/0048070 A1 2/2009 Vincent et al.
2009/0062032 A1 3/2009 Boyd et al.
2009/0075751 A1 3/2009 Gilbert et al.
2009/0098949 A1 4/2009 Chen
2009/0111602 A1 4/2009 Savarese et al.
2009/0118035 A1 5/2009 Roenick
2009/0120197 A1 5/2009 Golden et al.
2009/0124410 A1* 5/2009 Rife ..... A63B 53/0466 473/328
2009/0131190 A1 5/2009 Kimber
2009/0131191 A1 5/2009 Priester et al.
2009/0163285 A1 6/2009 Kwon et al.
2009/0163294 A1 6/2009 Cackett et al.
2009/0165530 A1 7/2009 Golden et al.
2009/0165531 A1 7/2009 Golden et al.
2009/0186717 A1 7/2009 Stites et al.
2009/0203460 A1 8/2009 Clark
2009/0203462 A1 8/2009 Stites et al.
2009/0209358 A1 8/2009 Niegowski
2009/0221380 A1 9/2009 Breier et al.
2009/0221381 A1 9/2009 Breier et al.
2009/0247312 A1 10/2009 Sato et al.
2009/0254204 A1 10/2009 Kostuj
2009/0260426 A1 10/2009 Lieberman et al.
2009/0264214 A1 10/2009 De La Cruz et al.
2009/0270743 A1 10/2009 Dugan et al.
2009/0286611 A1 11/2009 Beach et al.
2009/0318245 A1 12/2009 Yim et al.
2010/0016095 A1 1/2010 Burnett et al.
2010/0029402 A1 2/2010 Noble et al.
2010/0029408 A1 2/2010 Abe
2010/0035701 A1 2/2010 Kusumoto
2010/0048314 A1 2/2010 Hsu et al.
2010/0049468 A1 2/2010 Papadourakis
2010/0056298 A1 3/2010 Jertson et al.
2010/0063778 A1 3/2010 Schrock et al.
2010/0063779 A1 3/2010 Schrock et al.
2010/0067566 A1 3/2010 Rofougaran et al.
2010/0069171 A1 3/2010 Clausen et al.
2010/0093457 A1 4/2010 Ahern et al.
2010/0093458 A1 4/2010 Davenport et al.
2010/0093463 A1 4/2010 Davenport et al.
2010/0099509 A1 4/2010 Ahem et al.
2010/0113174 A1 5/2010 Ahern
2010/0113176 A1* 5/2010 Boyd ..... A63B 53/0466 473/291
2010/0113183 A1 5/2010 Soracco
2010/0113184 A1 5/2010 Kuan et al.
2010/0117837 A1 5/2010 Stirling et al.
2010/0121227 A1 5/2010 Stirling et al.
2010/0121228 A1 5/2010 Stirling et al.
2010/0130298 A1 5/2010 Dugan et al.
2010/0144455 A1 6/2010 Ahern
2010/0144456 A1 6/2010 Ahern
2010/0154255 A1 6/2010 Robinson et al.
2010/0190573 A1 7/2010 Boyd
2010/0197423 A1 8/2010 Thomas et al.
2010/0197426 A1 8/2010 De La Cruz et al.
2010/0201512 A1 8/2010 Stirling et al.
2010/0210371 A1 8/2010 Sato et al.
2010/0216563 A1 8/2010 Stites et al.
2010/0216564 A1 8/2010 Stites et al.
2010/0216565 A1 8/2010 Stites et al.
2010/0222152 A1 9/2010 Jaekel et al.
2010/0234127 A1 9/2010 Snyder et al.
2010/0255922 A1 10/2010 Lueders
2010/0261546 A1 10/2010 Nicodem
2010/0273569 A1 10/2010 Soracco
2010/0292024 A1 11/2010 Hagood et al.
2010/0304877 A1 12/2010 Iwahashi et al.
2010/0304887 A1 12/2010 Bennett et al.
2010/0308105 A1 12/2010 Savarese et al.
2011/0021284 A1 1/2011 Stites et al.
2011/0028230 A1 2/2011 Balardeta et al.
2011/0053698 A1 3/2011 Stites et al.
2011/0081978 A1 4/2011 Murdock et al.
2011/0082571 A1 4/2011 Murdock et al.
2011/0087344 A1 4/2011 Murdock et al.
2011/0092260 A1 4/2011 Murdock et al.
2011/0092310 A1 4/2011 Breier et al.
2011/0098127 A1 4/2011 Yamamoto
2011/0098128 A1 4/2011 Clausen et al.
2011/0118051 A1 5/2011 Thomas
2011/0130223 A1 6/2011 Murdock et al.
2011/0151977 A1 6/2011 Murdock et al.
2011/0151997 A1 6/2011 Shear

(56) References Cited

U.S. PATENT DOCUMENTS

| | | | | |
|---|---|---|---|---|
| 2011/0152001 | A1 | 6/2011 | Hirano | |
| 2011/0195798 | A1 | 8/2011 | Sander et al. | |
| 2011/0207552 | A1 | 8/2011 | Finn et al. | |
| 2011/0212757 | A1 | 9/2011 | Murdock et al. | |
| 2011/0217757 | A1 | 9/2011 | Chaplin et al. | |
| 2011/0218053 | A1* | 9/2011 | Tang | A63B 53/04 473/349 |
| 2011/0224011 | A1 | 9/2011 | Denton et al. | |
| 2011/0224025 | A1 | 9/2011 | Balardeta et al. | |
| 2011/0230273 | A1 | 9/2011 | Niegowski et al. | |
| 2011/0256951 | A1 | 10/2011 | Soracco et al. | |
| 2011/0256954 | A1 | 10/2011 | Soracco | |
| 2011/0281621 | A1 | 11/2011 | Murdock et al. | |
| 2011/0294599 | A1 | 12/2011 | Albertsen et al. | |
| 2011/0306435 | A1 | 12/2011 | Seo | |
| 2011/0312437 | A1* | 12/2011 | Sargent | A63B 53/02 473/335 |
| 2012/0019140 | A1 | 1/2012 | Maxik et al. | |
| 2012/0052972 | A1 | 3/2012 | Bentley | |
| 2012/0077615 | A1 | 3/2012 | Schmidt | |
| 2012/0083362 | A1 | 4/2012 | Albertsen et al. | |
| 2012/0083363 | A1 | 4/2012 | Albertsen et al. | |
| 2012/0120572 | A1 | 5/2012 | Bentley | |
| 2012/0122601 | A1 | 5/2012 | Beach et al. | |
| 2012/0142447 | A1 | 6/2012 | Boyd et al. | |
| 2012/0142452 | A1 | 6/2012 | Burnett et al. | |
| 2012/0165110 | A1 | 6/2012 | Cheng | |
| 2012/0165111 | A1 | 6/2012 | Cheng | |
| 2012/0184393 | A1 | 7/2012 | Franklin | |
| 2012/0191405 | A1 | 7/2012 | Molyneux et al. | |
| 2012/0196701 | A1 | 8/2012 | Stites et al. | |
| 2012/0202615 | A1 | 8/2012 | Beach et al. | |
| 2012/0225731 | A1* | 9/2012 | Suwa | A63B 53/02 473/314 |
| 2012/0244960 | A1 | 9/2012 | Tang et al. | |
| 2012/0270676 | A1 | 10/2012 | Burnett et al. | |
| 2012/0277029 | A1 | 11/2012 | Albertsen et al. | |
| 2012/0277030 | A1 | 11/2012 | Albertsen et al. | |
| 2012/0289354 | A1 | 11/2012 | Cottam et al. | |
| 2012/0302366 | A1 | 11/2012 | Murphy | |
| 2013/0017901 | A1* | 1/2013 | Sargent | A63B 53/0466 473/309 |
| 2013/0041590 | A1 | 2/2013 | Burich et al. | |
| 2013/0065705 | A1 | 3/2013 | Morales et al. | |
| 2013/0065711 | A1 | 3/2013 | Ueda et al. | |
| 2013/0102410 | A1 | 4/2013 | Stites et al. | |
| 2013/0130834 | A1 | 5/2013 | Stites et al. | |
| 2013/0165254 | A1 | 6/2013 | Rice et al. | |
| 2013/0210542 | A1 | 8/2013 | Harbert et al. | |
| 2013/0260922 | A1 | 10/2013 | Yontz et al. | |
| 2013/0324274 | A1 | 12/2013 | Stites | |
| 2013/0324284 | A1 | 12/2013 | Stites et al. | |
| 2014/0018184 | A1 | 1/2014 | Bezilla et al. | |
| 2014/0080627 | A1 | 3/2014 | Bennett et al. | |
| 2014/0080629 | A1 | 3/2014 | Sargent et al. | |
| 2014/0228649 | A1 | 8/2014 | Rayner et al. | |
| 2014/0256461 | A1* | 9/2014 | Beach | A63B 53/02 473/248 |
| 2014/0364246 | A1 | 12/2014 | Davenport | |
| 2015/0217167 | A1 | 8/2015 | Frame et al. | |
| 2015/0231453 | A1* | 8/2015 | Harbert | A63B 53/02 473/307 |

FOREIGN PATENT DOCUMENTS

| | | | | | |
|---|---|---|---|---|---|
| CN | 1198955 | A | | 11/1998 | |
| CN | 2411030 | Y | | 12/2000 | |
| CN | 2429210 | Y | | 5/2001 | |
| CN | 2431912 | Y | | 5/2001 | |
| CN | 2487416 | Y | | 4/2002 | |
| CN | 2688331 | Y | | 3/2005 | |
| CN | 1602981 | A | | 4/2005 | |
| CN | 1984698 | A | | 6/2007 | |
| CN | 101352609 | A | | 1/2009 | |
| CN | 101918090 | A | | 12/2010 | |
| CN | 101927084 | A | | 12/2010 | |
| CN | 102218209 | A | | 10/2011 | |
| CN | 104168965 | A | | 11/2014 | |
| DE | 202007013632 | U1 | | 12/2007 | |
| EP | 2332619 | A1 | | 6/2011 | |
| EP | 2377586 | A2 | | 10/2011 | |
| FR | 2672226 | A1 | | 8/1992 | |
| FR | 2717701 | A1 | | 9/1995 | |
| FR | 2717702 | A1 | | 9/1995 | |
| GB | 2280380 | A | | 2/1995 | |
| GB | 2388792 | A | | 11/2003 | |
| GB | 2422554 | A | | 8/2006 | |
| JP | S5163452 | U | | 5/1976 | |
| JP | 01259876 | | | 10/1989 | |
| JP | H05317465 | A | | 12/1993 | |
| JP | H06237 | | | 1/1994 | |
| JP | H06114127 | A | | 4/1994 | |
| JP | H0639036 | U | | 5/1994 | |
| JP | 06190088 | A | * | 7/1994 | A63B 53/04 |
| JP | H07255886 | A | | 10/1995 | |
| JP | H07275407 | A | | 10/1995 | |
| JP | H07284546 | A | | 10/1995 | |
| JP | H08000785 | | | 1/1996 | |
| JP | H08131599 | A | | 5/1996 | |
| JP | H08141117 | A | | 6/1996 | |
| JP | 08-173586 | | | 7/1996 | |
| JP | H08243195 | A | | 9/1996 | |
| JP | H0947528 | A | | 2/1997 | |
| JP | 3035480 | U | | 3/1997 | |
| JP | H09135932 | A | | 5/1997 | |
| JP | H9-239075 | | | 9/1997 | |
| JP | H09239074 | A | | 9/1997 | |
| JP | H09276455 | A | | 10/1997 | |
| JP | H9-299521 | | | 11/1997 | |
| JP | H10277180 | A | | 10/1998 | |
| JP | H10305119 | A | | 11/1998 | |
| JP | H1157082 | A | | 3/1999 | |
| JP | 11114102 | A | * | 4/1999 | A63B 53/04 |
| JP | H11169493 | A | | 6/1999 | |
| JP | H11244431 | A | | 9/1999 | |
| JP | 2980002 | B2 | | 11/1999 | |
| JP | 11299938 | | | 11/1999 | |
| JP | 2000-126340 | A | | 5/2000 | |
| JP | 2000176056 | A | | 6/2000 | |
| JP | 2000197718 | | | 7/2000 | |
| JP | 2000271253 | A | | 10/2000 | |
| JP | 2001009069 | A | | 1/2001 | |
| JP | 2001054596 | A | | 2/2001 | |
| JP | 2001058015 | | | 3/2001 | |
| JP | 2001062004 | | | 3/2001 | |
| JP | 2001137396 | | | 5/2001 | |
| JP | 2001145712 | | | 5/2001 | |
| JP | 2001264016 | A | | 9/2001 | |
| JP | 2001-293113 | A | | 10/2001 | |
| JP | 3216041 | B2 | | 10/2001 | |
| JP | 2002017908 | A | | 1/2002 | |
| JP | 2002017912 | A | | 1/2002 | |
| JP | 2002052099 | | | 2/2002 | |
| JP | 2002052099 | A | * | 2/2002 | A63B 53/04 |
| JP | 2002165905 | A | | 6/2002 | |
| JP | 2002177416 | A | | 6/2002 | |
| JP | 2002239040 | A | | 8/2002 | |
| JP | 2002248183 | A | | 9/2002 | |
| JP | 2002306646 | | | 10/2002 | |
| JP | 2002306647 | A | | 10/2002 | |
| JP | 2002320692 | | | 11/2002 | |
| JP | 2003000774 | | | 1/2003 | |
| JP | 2003079769 | | | 3/2003 | |
| JP | 2003093554 | A | | 4/2003 | |
| JP | 2003180887 | A | | 7/2003 | |
| JP | 2003210627 | | | 7/2003 | |
| JP | 2004174224 | A | * | 6/2004 | A63B 53/04 |
| JP | 2004216131 | A | | 8/2004 | |
| JP | 2004313762 | | | 11/2004 | |
| JP | 2004329544 | | | 11/2004 | |
| JP | 2004351054 | A | * | 12/2004 | A63B 53/04 |
| JP | 2004351173 | | | 12/2004 | |
| JP | 2004351173 | A | * | 12/2004 | A63B 53/04 |

(56) References Cited

FOREIGN PATENT DOCUMENTS

| | | | |
|---|---|---|---|
| JP | 2005013529 | A | 1/2005 |
| JP | 2005131280 | A | 5/2005 |
| JP | 2005193069 | | 7/2005 |
| JP | 2005253973 | A | 9/2005 |
| JP | 2005305178 | A | 11/2005 |
| JP | 2006000435 | A | 1/2006 |
| JP | 2006020817 | A | 1/2006 |
| JP | 2006175135 | A | 7/2006 |
| JP | 2006198251 | A | 8/2006 |
| JP | 2006223701 | A | 8/2006 |
| JP | 2006247023 | A | 9/2006 |
| JP | 20060231063 | | 9/2006 |
| JP | 2007209722 | A | 8/2007 |
| JP | 2007530151 | A | 11/2007 |
| JP | 2008036050 | A | 2/2008 |
| JP | 2008036315 | A | 2/2008 |
| JP | 2008506421 | A | 3/2008 |
| JP | 2008073210 | A | 4/2008 |
| JP | 2008515560 | A | 5/2008 |
| JP | 2008200118 | | 9/2008 |
| JP | 2008237689 | A | 10/2008 |
| JP | 2008289866 | A | 12/2008 |
| JP | 2009201744 | A | 9/2009 |
| JP | 2009534546 | A | 9/2009 |
| JP | 2010148652 | A | 7/2010 |
| JP | 2010148653 | A | 7/2010 |
| JP | 2010154875 | | 7/2010 |
| JP | 2010154887 | A | 7/2010 |
| JP | 2010279847 | A * | 12/2010 |
| JP | 2011024999 | A | 2/2011 |
| JP | 2011206535 | A | 10/2011 |
| KR | 20060090501 | A | 8/2006 |
| KR | 1020060114969 | | 11/2006 |
| KR | 1020070095407 | | 9/2007 |
| KR | 20090129246 | A | 12/2009 |
| KR | 1020100020131 | | 2/2010 |
| KR | 20100051153 | A | 5/2010 |
| KR | 10-2010-0095917 | A | 9/2010 |
| KR | 101002846 | B1 | 12/2010 |
| KR | 20110005247 | A | 1/2011 |
| TW | 498774 | U | 8/2002 |
| TW | I292575 | | 1/2008 |
| TW | I309777 | | 5/2009 |
| WO | 9920358 | A1 | 4/1999 |
| WO | 9965574 | A2 | 12/1999 |
| WO | 0149376 | A1 | 7/2001 |
| WO | 0215993 | A1 | 2/2002 |
| WO | 2004056425 | A2 | 7/2004 |
| WO | 20040071594 | A1 | 8/2004 |
| WO | 200505842 | A1 | 1/2005 |
| WO | 2005035073 | A1 | 4/2005 |
| WO | 2005058427 | A2 | 6/2005 |
| WO | 2005079933 | A1 | 9/2005 |
| WO | 2005094953 | A2 | 10/2005 |
| WO | 2005118086 | A1 | 12/2005 |
| WO | 2006014459 | A2 | 2/2006 |
| WO | 2006073930 | A2 | 7/2006 |
| WO | 2007123970 | A2 | 11/2007 |
| WO | 2008093710 | A1 | 8/2008 |
| WO | 2008157691 | A2 | 12/2008 |
| WO | 20080154684 | A1 | 12/2008 |
| WO | 2009035345 | A1 | 3/2009 |
| WO | 2009091636 | A1 | 7/2009 |
| WO | 2009152456 | A2 | 12/2009 |
| WO | 2010090814 | A1 | 8/2010 |
| WO | 2011153067 | A1 | 12/2011 |
| WO | 2012027726 | A2 | 3/2012 |
| WO | 2012138543 | A2 | 10/2012 |
| WO | 2012149385 | A1 | 11/2012 |
| WO | 2014070343 | A1 | 5/2014 |

OTHER PUBLICATIONS

Feb. 27, 2013—(WO) International Search Report and Written Opinion—App. PCT/US2012/067050.
Sep. 10, 2012—(WO) International Search Report App No. PCT/US2012/03542.
Jul. 31, 2013—(WO) International Search Report and Written Opinion—App. No. PCT/US2013/043700.
Aug. 2, 2013—(WO) International Search Report and Written Opinion—App. PCT/US2013/043656.
Sep. 4, 2014—(WO) International Search Report and Written Opinion—App. PCT/US2014/029044.
Nov. 30, 2012—(WO) International Search Report and Written Opinion App. PCT/US2012/052107.
May 6, 2011—(WO) International Search Report and Written Opinion—App. PCT/US2011/023968.
Mar. 24, 2014—(WO) International Search Report and Written Opinion—App. PCT/US2013/061812.
Aug. 21, 2015—(WO) International Search Report—App PCT/US2015/036578.
Oct. 28, 2015—(WO) International Searh Report and Written Opinion—App PCT/US2015/033371.
Sep. 28, 2015—(WO) International Search Report and Written Opinion—App PCT/US2015/032819.
http://www.sureshotgps.com/sureshotgps.php, Feb. 7, 2007.
Oct. 8, 2013—(WO) IPER PCT/US2012/031101.
Oct. 8, 2013—(WO) IPER PCT/US2012/031131.
Oct. 8, 2013—(WO) IPER PCT/US2012/031233.
Jan. 30, 2013—(WO) ISR PCT/US2012/031233.
Sep. 5, 2012—(WO) ISR PCT/US2012/031131.
Jan. 2, 2013—(WO) ISR PCT/US2012/031101.
Aug. 2, 2012—(WO) Partial International Search Report PCT/US2012/031233.
Aug. 2, 2012—(WO) Partial International Search Report PCT/US2012/031844.
Aug. 16, 2013—(WO) International Search Report and Written Opinion PCT/US2013/021466.
Jan. 30, 2013—(WO) International Search Report and Written Opinion PCT/US2012/031844.
Mar. 3, 2016—(WO) International Search Report and Written Opinion—App PCT/US2015/064755.
Dec. 18, 2012—(WO) International Search Report and Written Opinion App. No. PCT/US2012/057490.
Aug. 24, 2012—(WO) International Search Report and Written Opinion—App. PCT/US12/35476.
Aug. 8, 2013—(WO) International Preliminary Report on Patentability App. No. PCT/US2012/022027.
May 30, 2012—(WO) International Search Report and Written Opinion App. No. PCT/US2012/022027.
Nov. 26, 2010—(WO) International Search Report and Written Opinion App. No. PCT/US2010/043070.
"Photographs 1, 2 and 3", presented in U.S. Appl. No. 12/842,650, of unknown source, taken after the filing date of the U.S. Appl. No. 12/842,650, depicting a golf club product; presented to the Patent Office for consideration on Oct. 7, 2011.
Nov. 5, 2010—(WO) International Search Report & Written Opinion, App. No. PCT/US2009/064164.
Mar. 20, 2014—(WO) International Search Report and Written Opinion App. No. PCT/US2013/043641.
Nov. 6, 2013—(WO) Partial Search Report, App.No. PCT/US2013/043641.
Apr. 12, 2010—(WO) Partial Search Report App. No. PCT/US2010/021355.
Sep. 9, 2011—(WO) International Search Report and Written Opinion, App. No. PCT/US2011/023678.
Jul. 7, 2010—(WO) International Search Report and Written Opinion, App. PCT/US2010/021355.

* cited by examiner

GOLF CLUB HEAD OR OTHER BALL STRIKING DEVICE HAVING IMPACT-INFLUENCING BODY FEATURES

CROSS-REFERENCE TO RELATED APPLICATION

This present application is a continuation of U.S. Non-Provisional application Ser. No. 13/795,881 filed Mar. 12, 2013 which claims priority to and is a non-provisional of U.S. Provisional Application No. 61/653,937, filed May 31, 2012. U.S. Non-Provisional application Ser. No. 13/795,881 also claims priority to and is a continuation-in-part of U.S. patent application Ser. No. 13/308,036, filed Nov. 30, 2011, which claims priority to and is a non-provisional of U.S. Provisional Application No. 61/418,240, filed Nov. 30, 2010, and U.S. Provisional Application No. 61/541,767, filed Sep. 30, 2011, all of which applications are incorporated by reference herein in their entireties and made part hereof.

TECHNICAL FIELD

The invention relates generally to golf club heads and other ball striking devices that include impact influencing body features. Certain aspects of this invention relate to golf club heads and other ball striking devices that have a compression channel extending across at least a portion of the sole.

BACKGROUND

Golf clubs and many other ball striking devices may have various face and body features, as well as other characteristics, that can influence the use and performance of the device. For example, users may wish to have improved impact properties, such as increased coefficient of restitution (COR) in the face and/or increased size of the area of greatest response or COR (also known as the "hot zone") of the face. The present devices and methods are provided to address at least some of these problems and other problems, and to provide advantages and aspects not provided by prior ball striking devices. A full discussion of the features and advantages of the present invention is deferred to the following detailed description, which proceeds with reference to the accompanying drawings.

BRIEF SUMMARY

The following presents a general summary of aspects of the invention in order to provide a basic understanding of the invention. This summary is not an extensive overview of the invention. It is not intended to identify key or critical elements of the invention or to delineate the scope of the invention. The following summary merely presents some concepts of the invention in a general form as a prelude to the more detailed description provided below.

Aspects of the invention relate to a ball striking device, such as a golf club head, having a face with a striking surface configured for striking a ball, the face being defined by an outer periphery, and a body connected to the face and extending rearwardly from the outer periphery of the face, with the body having a sole configured to face a playing surface and a crown opposite the sole, and a channel extending across at least a portion of the sole. The channel has an inward recess defined between a front edge and a rear edge extending in a heel-toe direction, and the channel also has a center portion, a heel portion more proximate a heel of the body, and a toe portion more proximate a toe of the body. The rear edge is spaced rearwardly a different distance from the outer periphery of the face at the center portion as compared to at least one of the heel portion and the toe portion, such that a distance between the rear edge of the channel and the outer periphery of the face is different proximate the center portion as compared to a point proximate the heel or the toe. The channel may be configured to influence an impact of a ball on the striking surface by exerting a reaction force on the face in response to the impact.

According to one aspect, the rear edge may be spaced rearwardly a greater distance from the outer periphery of the face at the center portion as compared to at least one of the heel portion and the toe portion, such that a distance between the rear edge of the channel and the outer periphery of the face is larger proximate the center portion and smaller proximate the heel or the toe. The rear edge may be spaced rearwardly a greater distance from the outer periphery of the face at the center portion as compared both the heel portion and the toe portion in one configuration.

According to another aspect, the point is located more proximate to the toe of the body, and the rear edge is spaced rearwardly a different distance from the outer periphery of the face at the center portion as compared to the toe portion. The front edge and the rear edge may both be spaced rearwardly a different distance from the outer periphery of the face at the center portion as compared to the toe portion in one configuration. The width of the channel defined between the front and rear edges may also be greater proximate the center portion as compared to the heel portion and/or the toe portion. Additionally, the body may further include a spacing portion that junctures with the front edge of the channel at least at the center portion and forms a generally flattened surface extending from the front edge to proximate the outer periphery of the face to space the channel rearwardly from the outer periphery of the face. The spacing portion may be oriented at an acute angle to the striking surface of the face. The channel may additionally have surface texturing that is different from the spacing portion.

According to a further aspect, the front edge is also spaced rearwardly a different distance from the outer periphery of the face at the center portion as compared to at least one of the heel portion and the toe portion. The body may further include a spacing portion that junctures with the front edge of the channel at least at the center portion and extends from the front edge to proximate the outer periphery of the face to space the channel rearwardly from the outer periphery of the face. In this configuration, the spacing portion has a width, defined between the front edge of the channel and the outer periphery of the face, that is different at a center of the spacing portion as compared to a second point more proximate to the heel or the toe of the body.

According to yet another aspect, the device also includes a stiffening rib on the sole, spaced rearwardly from the channel, where the stiffening rib increases the stiffness of the sole. The stiffening rib may project inwardly into the body.

According to a still further aspect, the wall thickness of the body may be reduced at the channel as compared to the wall thickness at other locations of the body.

Additional aspects of the invention relate to a ball striking device that includes a face having a striking surface configured for striking a ball and being defined by an outer periphery, a body connected to the face and extending rearwardly from the outer periphery of the face, the body having a sole configured to face a playing surface and a crown opposite the sole, and a channel extending across at least a portion of the sole of the body. The channel includes an inward recess defined between a front edge and a rear edge extending in a heel-toe direction, with the front edge being spaced rearwardly from the outer periphery of the face. The rear edge of the channel is bowed rearwardly away from the face at a center of the channel, such that a distance between the rear edge of the channel and the outer periphery of the face is larger proximate the center of the channel and is smaller proximate at least one of the heel and the toe. The channel may be configured to influence an impact of a ball on the striking surface by exerting a reaction force on the face in response to the impact. The device may include any of the components and features described above.

According to one aspect, the distance between the rear edge and the outer periphery of the face is larger proximate the center of the channel and is smaller proximate the toe, or smaller proximate both the heel and the toe.

According to another aspect, the front edge is also bowed rearwardly away from the face at the center of the channel, such that a distance between the front edge of the channel and the outer periphery of the face is larger proximate the center of the channel and is smaller proximate at least one of the heel and the toe.

Further aspects of the invention relate to a ball striking device that includes a face having a striking surface configured for striking a ball and being defined by an outer periphery, a body connected to the face and extending rearwardly from the outer periphery of the face, the body having a sole configured to face a playing surface and a crown opposite the sole, a recessed channel extending across at least a portion of the sole of the body, and a stiffening rib on the sole, spaced rearwardly from the channel. The stiffening rib increases the stiffness of the sole. The channel is defined between a front edge and a rear edge extending in a heel-toe direction, and has a center portion, a heel portion more proximate a heel of the body, and a toe portion more proximate a toe of the body. At least one of the front and rear edges is spaced rearwardly a different distance from the outer periphery of the face at the center portion as compared to a point proximate the heel or the toe. The device may include any of the components and features described above.

According to one aspect, the rear edge is spaced rearwardly a greater distance from the outer periphery of the face at the center portion as compared to the point proximate the heel or the toe. Further, the rear edge may be spaced rearwardly a greater distance from the outer periphery of the face at the center portion as compared to points proximate both the heel and the toe. The width of the channel defined between the front and rear edges may also be greater proximate the center portion and smaller proximate both the heel and the toe.

According to another aspect, the device may include multiple stiffening ribs on the sole, spaced rearwardly from the channel, where each stiffening rib increases the stiffness of the sole. Each of the stiffening ribs may project inwardly into the body.

Still further aspects of the invention relate to golf clubs that include a golf club head or other device as described above and a shaft connected to the head.

Other features and advantages of the invention will be apparent from the following description taken in conjunction with the attached drawings.

BRIEF DESCRIPTION OF THE DRAWINGS

To allow for a more full understanding of the present invention, it will now be described by way of example, with reference to the accompanying drawings in which.

DETAILED DESCRIPTION

Figure 1:
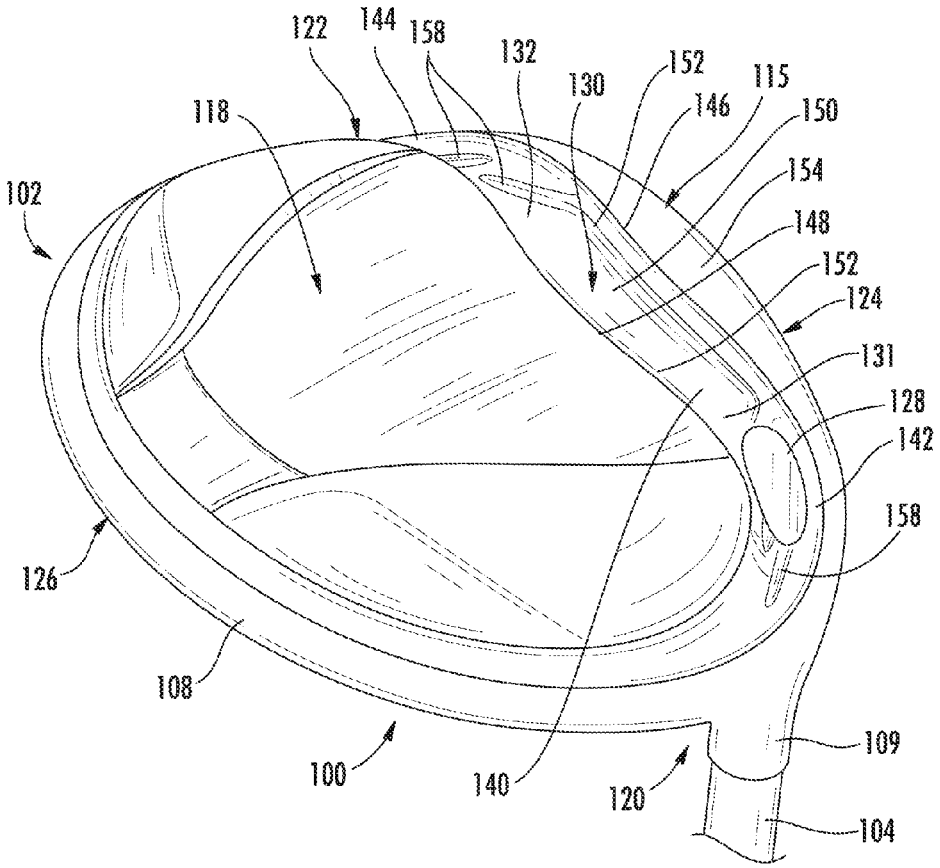
FIG. 1 is a bottom rear perspective view of one embodiment of a ball striking device according to aspects of the present invention, in the form of a golf driver.

In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention. Also, while the terms "top," "bottom," "front," "back," "side," "rear," and the like may be used in this specification to describe various example features and elements of the invention, these terms are used herein as a matter of convenience, e.g., based on the example orientations shown in the figures or the orientation during typical use. Additionally, the term "plurality," as used herein, indicates any number greater than one, either disjunctively or conjunctively, as necessary, up to an infinite number. Nothing in this specification should be construed as requiring a specific three dimensional orientation of structures in order to fall within the scope of this invention. Also, the reader is advised that the attached drawings are not necessarily drawn to scale.

The following terms are used in this specification, and unless otherwise noted or clear from the context, these terms have the meanings provided below.

"Ball striking device" means any device constructed and designed to strike a ball or other similar objects (such as a hockey puck). In addition to generically encompassing "ball striking heads," which are described in more detail below, examples of "ball striking devices" include, but are not limited to: golf clubs, putters, croquet mallets, polo mallets, baseball or softball bats, cricket bats, tennis rackets, badminton rackets, field hockey sticks, ice hockey sticks, and the like.

"Ball striking head" (or "head") means the portion of a "ball striking device" that includes and is located immediately adjacent (optionally surrounding) the portion of the ball striking device designed to contact the ball (or other object) in use. In some examples, such as many golf clubs and putters, the ball striking head may be a separate and independent entity from any shaft member, and it may be attached to the shaft in some manner.

The term "shaft" includes the portion of a ball striking device (if any) that the user holds during a swing of a ball striking device.

"Integral joining technique" means a technique for joining two pieces so that the two pieces effectively become a single, integral piece, including, but not limited to, irreversible joining techniques, such as adhesively joining, cementing, welding, brazing, soldering, or the like, where separation of the joined pieces cannot be accomplished without structural damage thereto.

"Generally parallel" means that a first line, segment, plane, edge, surface, etc. is approximately (in this instance, within 5%) equidistant from with another line, plane, edge, surface, etc., over at least 50% of the length of the first line, segment, plane, edge, surface, etc.

In general, aspects of this invention relate to ball striking devices, such as golf club heads, golf clubs, and the like. Such ball striking devices, according to at least some examples of the invention, may include a ball striking head with a ball striking surface. In the case of a golf club, the ball striking surface is a substantially flat surface on one face of the ball striking head. Some more specific aspects of this invention relate to wood-type golf clubs and golf club heads, including fairway woods, hybrid clubs, and the like, as well as other wood-type golf clubs such as drivers, although aspects of this invention also may be practiced on iron-type clubs, putters, and other club types as well.

According to various aspects of this invention, the ball striking device may be formed of one or more of a variety of materials, such as metals (including metal alloys), ceramics, polymers, composites (including fiber-reinforced composites), and wood, and may be formed in one of a variety of configurations, without departing from the scope of the invention. In one illustrative embodiment, some or all components of the head, including the face and at least a portion of the body of the head, are made of metal (the term "metal," as used herein, includes within its scope metal alloys). It is understood that the head may contain components made of several different materials, including carbon-fiber composites, polymer materials, and other components. Additionally, the components may be formed by various forming methods. For example, metal components (such as titanium, aluminum, titanium alloys, aluminum alloys, steels (including stainless steels), and the like) may be formed by forging, molding, casting, stamping, machining, and/or other known techniques. In another example, composite components, such as carbon fiber-polymer composites, can be manufactured by a variety of composite processing techniques, such as prepreg processing, powder-based techniques, mold infiltration, and/or other known techniques. In a further example, polymer components, such as high strength polymers, can be manufactured by polymer processing techniques, such as various molding and casting techniques and/or other known techniques.

The various figures in this application illustrate examples of ball striking devices according to this invention. When the same reference number appears in more than one drawing, that reference number is used consistently in this specification and the drawings refer to the same or similar parts throughout.

At least some examples of ball striking devices according to this invention relate to golf club head structures, including heads for wood-type golf clubs, such as drivers, fairway woods and hybrid clubs, as well as other types of wood-type clubs, long iron clubs (e.g., driving irons, zero irons through five irons, and hybrid type golf clubs), short iron clubs (e.g., six irons through pitching wedges, as well as sand wedges, lob wedges, gap wedges, and/or other wedges), and putters. Such devices may include a one-piece construction or a multiple-piece construction. Example structures of ball striking devices according to this invention will be described in detail below in conjunction with FIGS. 1-4, which illustrate one illustrative embodiment of a ball striking device 100 in the form of a wood-type golf club (e.g. a driver), although it is understood that similar configurations may be used for other wood-type clubs, including a fairway wood (e.g., a 3-wood, 5-wood, 7-wood, etc.), as illustrated in FIGS. 6-9, or a hybrid club, as illustrated in FIGS. 10-13.

Figure 2:
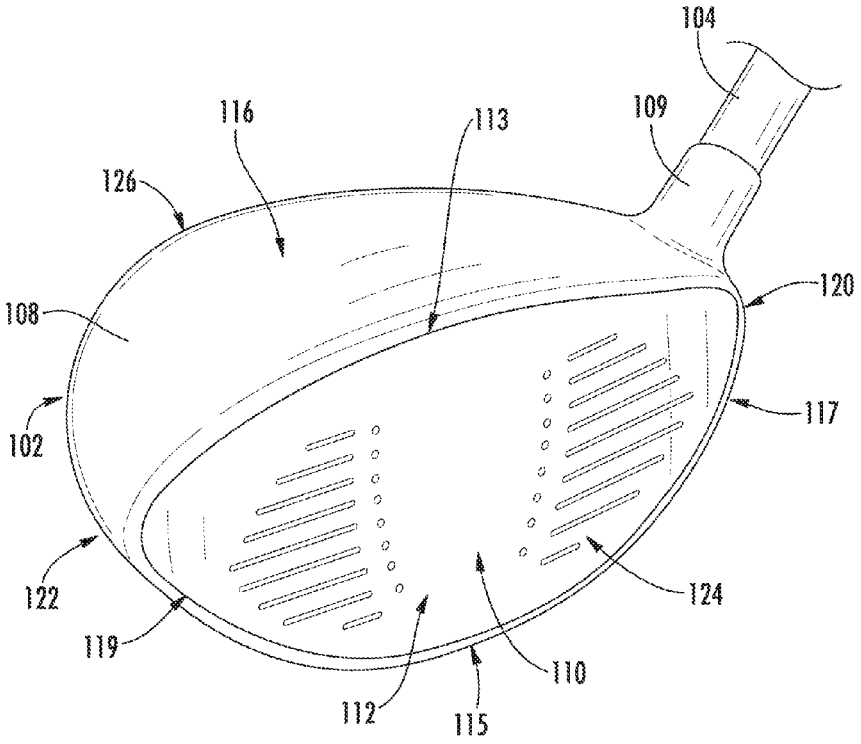
FIG. 2 is a top front perspective view of the ball striking device of FIG. 1.
Figure 3:
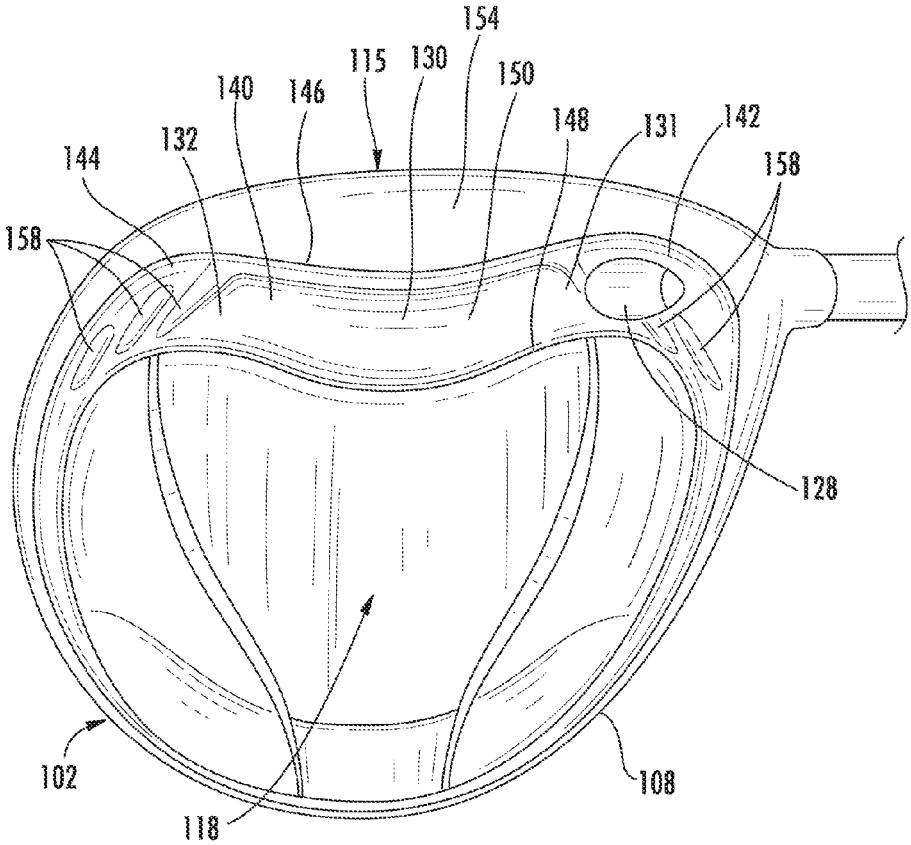
FIG. 3 is a bottom view of the ball striking device of FIG. 1.
Figure 4:
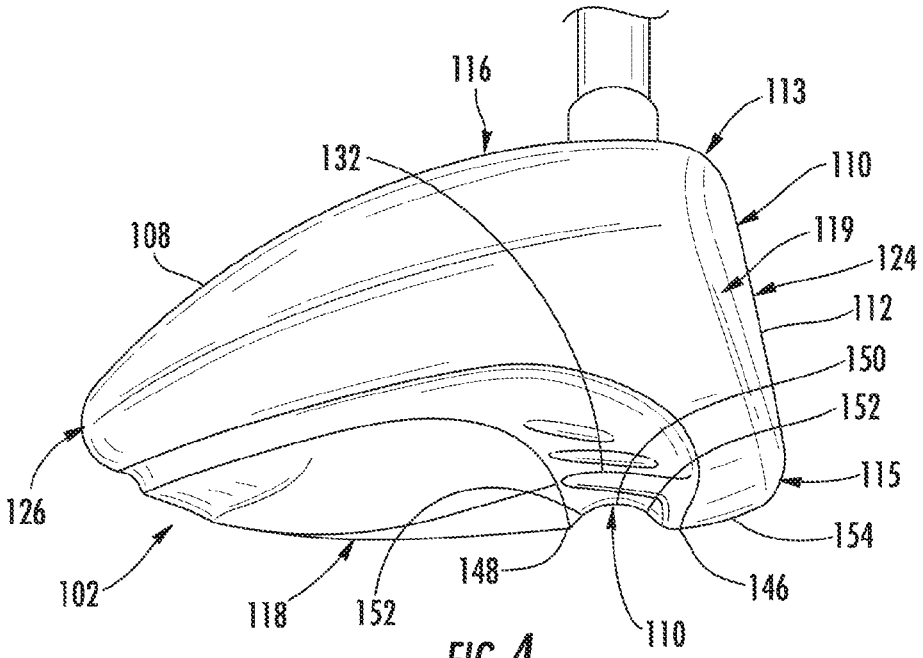
FIG. 4 is a side view of the ball striking device of FIG. 1.

The golf club 100 shown in FIGS. 1-4 includes a ball striking head 102 configured to strike a ball in use and a shaft 104 connected to the ball striking head 102 and extending therefrom. FIGS. 1-4 illustrate one embodiment of a ball striking head 102 in the form of a golf club head 102 that has a face 112 connected to a body 108, with a hosel 109 extending therefrom and a shaft 104 connected to the hosel 109. Any desired hosel and/or head/shaft interconnection structure 111 may be used without departing from this invention, including conventional hosel or other head/shaft interconnection structures 111 as are known and used in the art, or an adjustable, releasable, and/or interchangeable hosel or other head/shaft interconnection structure 111 such as those shown and described in U.S. Pat. No. 6,890,269 dated May 10, 2005, in the name of Bruce D. Burrows, U.S. Published Patent Application No. 2009/0011848, filed on Jul. 6, 2007, in the name of John Thomas Stites, et al., U.S. Published Patent Application No. 2009/0011849, filed on Jul. 6, 2007, in the name of John Thomas Stites, et al., U.S. Published Patent Application No. 2009/0011850, filed on Jul. 6, 2007, in the name of John Thomas Stites, et al., and U.S. Published Patent Application No. 2009/0062029, filed on Aug. 28, 2007, in the name of John Thomas Stites, et al., all of which are incorporated herein by reference in their entireties. The head 102 may have an opening or other access 128 for the adjustable hosel 109 features that extends through the sole 118, as seen in FIGS. 1 and 3.

For reference, the head 102 generally has a top or crown 116, a bottom or sole 118, a heel 120 proximate the hosel 109, a toe 122 distal from the hosel 109, a front 124, and a back or rear 126, as shown in FIGS. 1-4. The shape and design of the head 102 may be partially dictated by the intended use of the golf club 100. For example, it is understood that the sole 118 is configured to face the playing surface in use. With clubs that are configured to be capable of hitting a ball resting directly on the playing surface, such as a fairway wood, hybrid, iron, etc., the sole 118 may contact the playing surface in use, and features of the club may be designed accordingly. In the club 100 shown in FIGS. 1-4, the head 102 has an enclosed volume, as the club 100 is a wood-type club designed for use as a driver, intended to hit the ball long distances. In other applications, such as for a different type of golf club, the head 102 may be designed to have different dimensions and configurations. For example, when configured as a driver, the club head 102 may have a volume of at least 400 cc, and in some structures, at least 450 cc, or even at least 460 cc. If instead configured as a fairway wood (e.g., FIGS. 6-9), the head may have a volume of 120 cc to 230 cc, and if configured as a hybrid club (e.g., FIGS. 10-13), the head may have a volume of 85 cc to 140 cc. Other appropriate sizes for other club heads may be readily determined by those skilled in the art. The club head 102 loft angle also may vary, e.g., depending on the shot distance desired for the club head 102.

The body 108 of the head 102 can have various different shapes, including a rounded shape, as in the head 102 shown in FIGS. 1-4, a squared or rectangular shape, or any other of a variety of other shapes. It is understood that such shapes may be configured to distribute weight in any desired, manner, e.g., away from the face 112 and/or the geometric/volumetric center of the head 102, in order to create a lower center of gravity and/or a higher moment of inertia.

In the illustrative embodiment illustrated in FIGS. 1-4, the head 102 has a hollow structure defining an inner cavity (not shown) (e.g., defined by the face 112 and the body 108) with a plurality of inner surfaces defined therein. In one embodiment, the inner cavity may be filled with air. However, in other embodiments, the head 102 could be filled with another material, such as foam. In still further embodiments, the solid materials of the head may occupy a greater proportion of the volume, and the head may have a smaller cavity or no inner cavity at all. It is understood that the inner cavity may not be completely enclosed in some embodiments.

The face 112 is located at the front 124 of the head 102 and has a ball striking surface (or striking surface) 110 located thereon and an inner surface (not shown) opposite the ball striking surface 110, as illustrated in FIG. 2. The ball striking surface 110 is typically an outer surface of the face 112 configured to face a ball in use and is adapted to strike the ball when the golf club 100 is set in motion, such as by swinging. As shown, the ball striking surface 110 is relatively flat, occupying at least a majority of the face 112. The face 112 has an outer periphery formed of a plurality of outer or peripheral edges, including a top edge 113, a bottom edge 115, and lateral edges (including heel edge 117 and toe edge 119). The edges of the face 112 may be defined as the boundaries of an area of the face 112 that is specifically designed to contact the ball in use, and may be recognized as the boundaries of an area of the face 112 that is intentionally shaped and configured to be suited for ball contact. The face 112 may include some curvature in the top to bottom and/or heel to toe directions (e.g., bulge and roll characteristics), as is known and is conventional in the art. In other embodiments, the surface 110 may occupy a different proportion of the face 112, or the body 108 may have multiple ball striking surfaces 110 thereon. In the illustrative embodiment shown in FIGS. 1-4, the ball striking surface 110 is inclined with respect to the ground or contact surface (i.e., at a loft angle), to give the ball a desired lift and spin when struck. In other illustrative embodiments, the ball striking surface 110 may have a different incline or loft angle, to affect the trajectory of the ball. Additionally, the face 112 may have a variable thickness and also may have one or more internal or external inserts and/or supports in some embodiments.

It is understood that the face 112, the body 108, and/or the hosel 109 can be formed as a single piece or as separate pieces that are joined together. The face 112 may be formed as a face plate member with the body 108 being partially or wholly formed by one or more separate pieces connected to the face plate member. The face 112 may alternately be formed as part of a face frame member with the body 108 being partially or wholly formed by one or more separate pieces connected to the face frame member, with a wall or walls extending rearward from the edges of the face 112 (these rearward extending walls also may be referred to as a "return portion"). This configuration may also be known as a "cup face" structure in some configurations. The face frame member may also have an L-shaped configuration. Additionally, at least a portion of the body 108 may be formed as a separate piece or pieces joined to the wall(s) of the face frame member, such as by a backbody member attached to the cup face structure, composed of a single piece or multiple pieces. These pieces may be connected by an integral joining technique, such as welding, cementing, or adhesively joining. Other known techniques for joining these parts can be used as well, including many mechanical joining techniques, including releasable mechanical engagement techniques. If desired, the hosel 109 may be integrally formed as part of the face frame member. Further, a gasket (not shown) may be included between the cup face structure and the backbody member.

The golf club 100 may include a shaft 104 connected to or otherwise engaged with the ball striking head 102 as shown in FIG. 2. The shaft 104 is adapted to be gripped by a user to swing the golf club 100 to strike the ball. The shaft 104 can be formed as a separate piece connected to the head 102, such as by connecting to the hosel 109, as shown in FIG. 1. In other illustrative embodiments, at least a portion of the shaft 104 may be an integral piece with the head 102, and/or the head 102 may not contain a hosel 109 or may contain an internal hosel structure. Still further embodiments are contemplated without departing from the scope of the invention. The shaft 104 may be constructed from one or more of a variety of materials, including metals, ceramics, polymers, composites, or wood. In some illustrative embodiments, the shaft 104, or at least portions thereof, may be constructed of a metal, such as stainless steel or titanium, or a composite, such as a carbon/graphite fiber-polymer composite. However, it is contemplated that the shaft 104 may be constructed of different materials without departing from the scope of the invention, including conventional materials that are known and used in the art. A grip element (not shown) may be positioned on the shaft 104 to provide a golfer with a slip resistant surface with which to grasp golf club shaft 104. The grip element may be attached to the shaft 104 in any desired manner, including in conventional manners known and used in the art (e.g., via adhesives or cements, threads or other mechanical connectors, swedging/swaging, etc.).

In general, the ball striking heads 102 according to the present invention include features on the body 108 that influence the impact of a ball on the face 112, such as one or more compression channels 140 positioned on the body 108 of the head 102 that allow at least a portion of the body 108 to flex, produce a reactive force, and/or change the behavior or motion of the face 112, during impact of a ball on the face 112. In one embodiment, at least a portion of the compression channel 140 is curved or bowed away from the outer periphery of the face 112. In the golf club 100 shown in FIGS. 1-4, the head 102 includes a single channel 140 located on the sole 118 of the head 102. As described below, this channel 140 permits compression and flexing of the body 108 during impact on the face 112, and can also produce a reactive force that can be transferred to the ball. This illustrative embodiment is described in greater detail below.

The golf club 100 shown in FIGS. 1-4 includes a compression channel 140 positioned on the sole 118 of the head 102, and which may extend continuously across at least a portion of the sole 118. In other embodiments, the head 102 may have a channel 140 positioned differently, such as on the crown 116, the heel 120, and/or the toe 122. It is also understood that the head 102 may have more than one channel 140, or may have an annular channel extending around the entire or substantially the entire head 102. As illustrated in FIGS. 1-4, the channel 140 of this example structure is elongated, extending between a first end 142 located proximate the heel 120 of the head 102 and a second end 144 located proximate the toe 122 of the head 102. The channel 140 has a boundary that is defined by a first or front edge 146 and a second or rear edge 148 that extend between the ends 142, 144. In this embodiment, the channel 140 extends adjacent to and along the bottom edge 115 of the face 112, and further extends into the heel 120 and toe 122 areas of the head 102. As seen in FIGS. 1-4, the channel 140 is substantially symmetrically positioned on the head 102 in this embodiment. In other embodiments, the channel 140 may be oriented and/or positioned differently. For example, the channel 140 may be oriented adjacent to a different edge of the face 112, and at least a portion of the channel 140 may be parallel or generally parallel to one or more of the edges of the face 112. The size and shape of the compression channel 140 also may vary widely without departing from this invention.

The channel 140 is recessed inwardly with respect to the immediately adjacent surfaces of the head 102 that extend from and/or are in contact with the edges 146, 148 of the channel 140, as shown in FIGS. 1-4. The channel 140 in this embodiment has a curved and generally semi-circular cross-sectional shape or profile, with a trough 150 and sloping, depending side walls 152 that are smoothly curvilinear, extending from the trough 150 to the respective edges 146, 148 of the channel 140. The trough 150 forms the deepest (i.e. most inwardly-recessed) portion of the channel 140 in this embodiment. It is understood that the channel 140 may have a different cross-sectional shape or profile, such as having a sharper and/or more polygonal (e.g. rectangular) shape in another embodiment. Additionally, the channel 140 may generally taper in depth so that the trough 150 has a greater depth at and around a center portion 130 of the channel 140 and is shallower at heel and toe portions 131, 132 of the channel 140. The channel 140 in the embodiment of FIGS. 1-4 generally extends around the edges of the sole 118 to some degree, although the deepest portion of the channel 140 (i.e. the trough 150) is located only near the front 124 of the head 102, and the rear portions of the channel 140 have a much shallower depth. Further, the channel 140 may have ridges or swales 158 located at the heel and toe portions 131, 132 of the channel 140. The ridges 158 generally define a boundary of the deepest portion of the channel 140 in the embodiment of FIGS. 1-4.

Additionally, in one embodiment, the wall thickness of the body 108 may be reduced at the channel 140, as compared to the thickness at other locations of the body 108, to provide for increased flexibility at the channel 140. In one embodiment, the wall thickness in the channel 140 is from 0.8-1.5 mm.

In the embodiment shown in FIGS. 1-4, the channel 140 is spaced from the bottom edge 115 of the face 112, with a spacing portion 154 defined between the channel 140 and the bottom edge 115. The spacing portion 154 is located immediately adjacent the channel 140 and junctures with one of the side walls 152 of the channel 140 along the front edge 146 of the channel 140, as shown in FIGS. 1-4. In this embodiment, the spacing portion 154 is oriented at an acute (i.e. <90°) angle to the ball striking surface 110 and extends rearward from the bottom edge 115 of the face 112 to the channel 140. Force from an impact on the face 112 can be transferred to the channel 140 through the spacing portion 154, as described below. In other embodiments, the spacing portion 154 may be oriented at a right angle or an obtuse angle to the ball striking surface 110, and/or the spacing portion 154 may be smaller than shown in FIGS. 1-4 or absent entirely. The spacing portion 154 is generally flattened in the embodiment of FIGS. 1-4. If desired, as another example, a smoothly curved surface may extend from the bottom edge 115 of the face 112 directly into the interior side walls 152 of the channel 140.

In one embodiment, the channel 140, or at least a portion thereof, is curved or bowed. The head 102 as illustrated in FIGS. 1-4 has a channel 140 that generally has a center portion 130 that is curved and bowed rearwardly, i.e. away from the face 112, and is spaced rearwardly a greater distance from the face 112 than adjacent portions of the channel 140. As seen in FIGS. 1 and 3, in this embodiment, the channel 140 has a heel portion 131 and a toe portion 132 that are spaced rearwardly approximately equal distances from the outer periphery of the face 112 and the center portion 130 that is spaced a greater distance from the face 112 than the heel or toe portions 131, 132. The center portion 130 in this embodiment is generally symmetrical and generally aligned with the geometric centerline of the body 108, however this arrangement and alignment may be different in other embodiments, depending at least in part on the geometry and symmetry of the body 108.

The front and rear edges 146, 148 of the channel 140 in the embodiment of FIGS. 1-4 are both curved and bowed away from the face 112. In this configuration, the edges 146, 148 are both spaced farther rearwardly from the face 112 at the center portion 130 as compared to opposed ends of each of the edges 146, 148, which may be located at the heel and toe portions 131, 132 and are positioned more closely to the periphery of the face 112. Additionally, the degrees of curving and bowing of the edges 146, 148 are slightly different in this embodiment, so that the width (measured in the front 124 to rear 126 direction) of the channel 140 is slightly larger at the center portion 130 and slightly narrower at the heel and toe portions 131, 132. In other embodiments, only one of the edges 146, 148 may be curved and/or bowed, and the width of the channel 140 may vary in a different manner, such as if one of the edges 146, 148 is curved and/or bowed to a much greater degree than the other. In another embodiment, the width of the channel 140 may be consistent and approximately equal from the heel portion 131 to the toe portion 132. In an alternate embodiment, one or both of the edges 146, 148 may be bowed toward the face 112, rather than away from the face 112. Further, the width (measured in the front 124 to rear 126 direction) of the spacing portion 154 also varies with the bowed front edge 146 of the channel 140, such that the width is greater at the center of the spacing portion 154 (proximate the center portion 130) and smaller proximate the heel portion 131 and the toe portion 132 of the channel 140. As seen in FIGS. 1 and 3, the width of the spacing portion 154 decreases by tapering from the center and becomes smaller toward the heel portion 131 and the toe portion 132 of the channel 140. The spacing portion 154 has the greatest width at approximately the geometric centerline of the body 108 and is generally symmetrical with respect to the geometric centerline in this embodiment as well. In other embodiments, the configuration of the spacing portion 154 may be different.

The deepest part of the channel 140, represented by the trough 150, also has a curved and bowed configuration in one embodiment, such as the embodiment shown in FIGS. 1-4. In this embodiment, the trough 150 has opposed ends (e.g. at the heel and toe portions 131, 132) that are more proximate to the periphery of the face 112 than the center of the trough 150 (e.g. at the center portion 130). Additionally, the trough 150 of the channel 140 in this embodiment is generally curved and bowed similarly to the front and rear edges 146, 148 of the channel 140, such that the trough 150 remains generally equidistant from the front and rear edges 146, 148 between the heel and toe portions 131, 132. In another embodiment, the side walls 152 of the channel 140 may be contoured differently, such that the trough 150 is curved and/or bowed differently. For example, in one configuration, one or both of the front and rear edges 146, 148 may be curved, while the trough 150 may not be curved, and in another configuration, the front and rear edges 146, 148 may not be curved, while the trough 150 may be curved. In a further configuration, the trough 150 may be curved and/or bowed in an opposite manner to one or both of the edges 146, 148. Still other configurations are possible.

In one embodiment, part or all of the channel 140 may have surface texturing or another surface treatment that affects the properties of the channel 140. For example, certain surface treatments, such as peening, coating, etc., may increase the stiffness of the channel and reduce flexing. As another example, other surface treatments may be used to create greater flexibility in the channel 140. As a further example, surface treatments may increase the smoothness of the channel 140 and/or the smoothness of transitions (e.g. the edges 146, 148) of the channel 140, which can influence aerodynamics, interaction with playing surfaces, visual appearance, etc. Further surface texturing or other surface treatments may be used as well.

The compression channel 140 of the head 102 shown in FIGS. 1-4 can influence the impact of a ball (not shown) on the face 112 of the head 102, as similarly described in U.S. patent application Ser. No. 13/015,264, filed Jan. 27, 2011, which is incorporated by reference herein in its entirety. In one embodiment, the channel 140 can influence the impact by flexing and/or compressing in response to the impact on the face 112, and/or by exerting a reaction force on the face 112 during impact. For example, when the ball impacts the face 112, the face 112 flexes inwardly. Additionally, some of the impact force is transferred through the spacing portion 154 to the channel 140, causing the sole 118 to flex at the channel 140. This flexing of the channel 140 may result in a smaller degree of deformation of the ball as compared to a traditional head, which can assist in achieving greater impact efficiency and greater energy and velocity transfer to the ball during impact. The more gradual impact created by the flexing also creates a longer impact time, which can also result in greater energy and velocity transfer to the ball during impact. Further, as the compressed channel 140 expands to return to its initial shape, a responsive or reactive force is exerted on the face 112, creating an increased "trampoline" effect, which can result in greater energy and velocity transfer to the ball during impact. Still further, because the channel 140 extends toward the heel 120 and toe 122, the head 102 can achieve increased energy and velocity transfer to the ball for impacts that are away from the center or traditional "sweet spot" of the face 112. It is understood that a channel 140 may be additionally or alternately incorporated into the crown 116 and/or sides 120, 122 of the body 108 in order to produce similar effects for energy and velocity transfer. For example, in one embodiment, the head 102 may have one or more channels 140 extending completely or substantially completely around the periphery of the body 108, such as shown in U.S. patent application Ser. No. 13/308,036, filed Nov. 30, 2011, which is incorporated by reference herein in its entirety. At least a portion of a channel 140 in this configuration may be curved or bowed away from the outer periphery of the face 112, as described above, and the channel 140 may have such curved/bowed portions on both the top 116 and the sole 118 in one embodiment. It is understood that the head 102 may have one or more channels 140 in a different configuration in other embodiments.

The curved and/or bowed configuration of the channel 140 may assist in controlling the flexing of the channel 140 and/or achieving a desired flexibility. For example, certain features of the head 102 (e.g. the access 128) may influence the flexibility of the channel 140, and the curved/bowed configuration of the channel 140 may assist in retaining the same flexibility as the channel 140 would have without the features in question. As another example, the curved/bowed configuration of the channel 140 may assist in achieving a desired flexibility for the channel 140, such as for a particular application. Other effects and properties may be achieved by channels 140 that are curved/bowed as shown in FIGS. 1-4 or in other configurations, and the configuration of the channel 140 may work in conjunction with other features to influence the flexibility of the channel 140.

Figure 5:
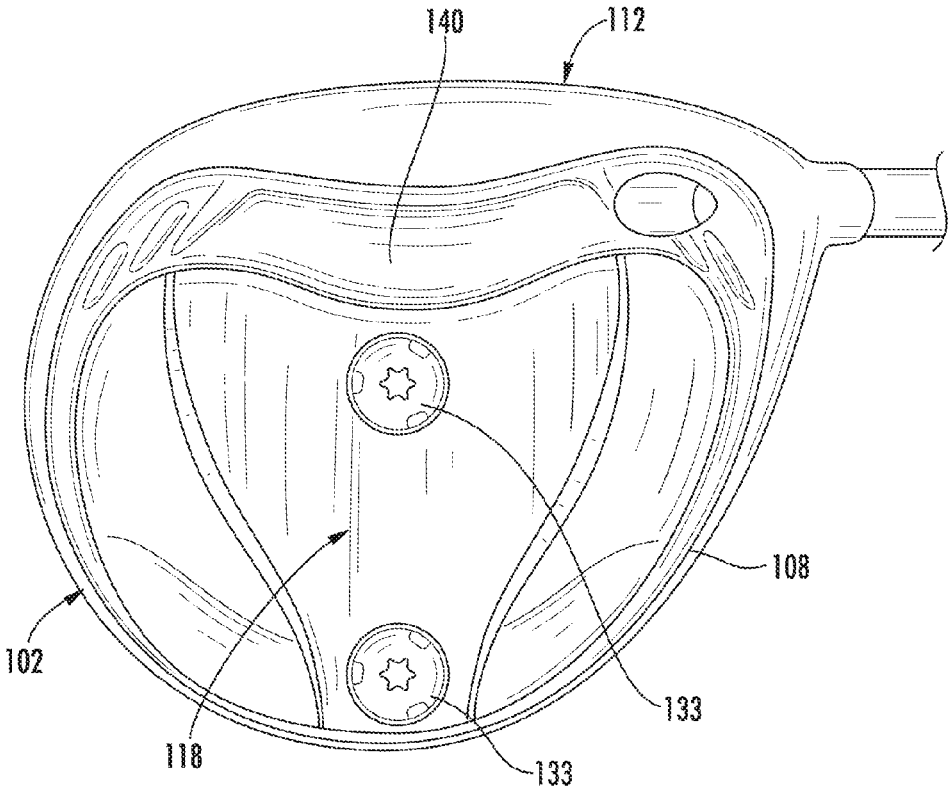
FIG. 5 is a bottom view of another embodiment of a ball striking device according to aspects of the present invention, in the form of a golf driver.
Figure 6:
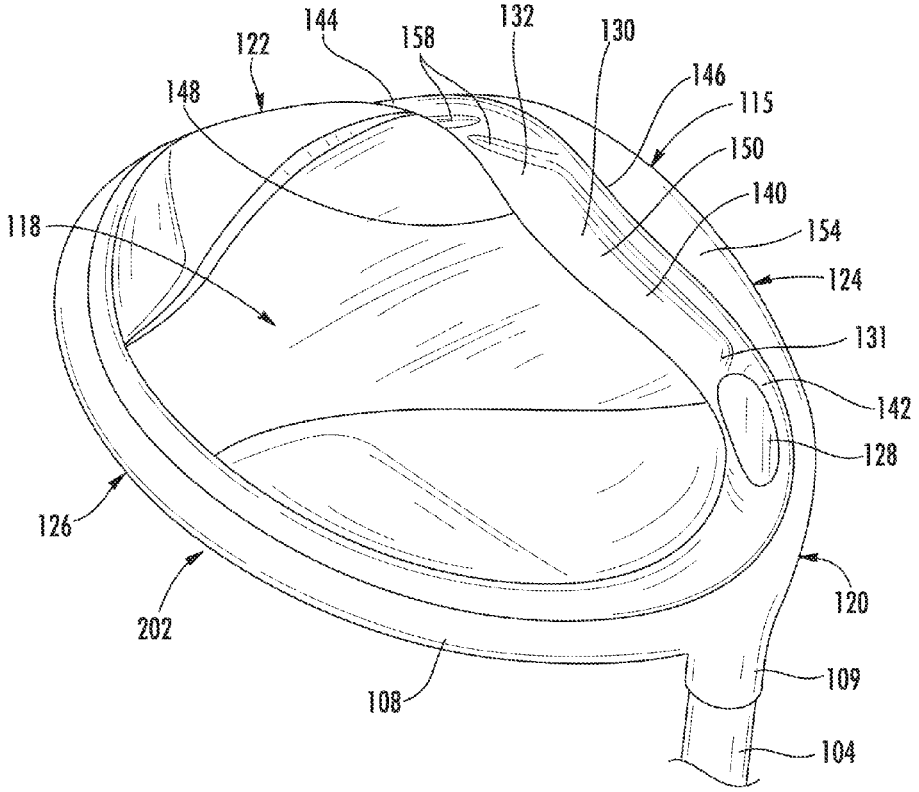
FIG. 6 is a bottom rear perspective view of another embodiment of a ball striking device according to aspects of the present invention, in the form of a golf fairway wood.
Figure 7:
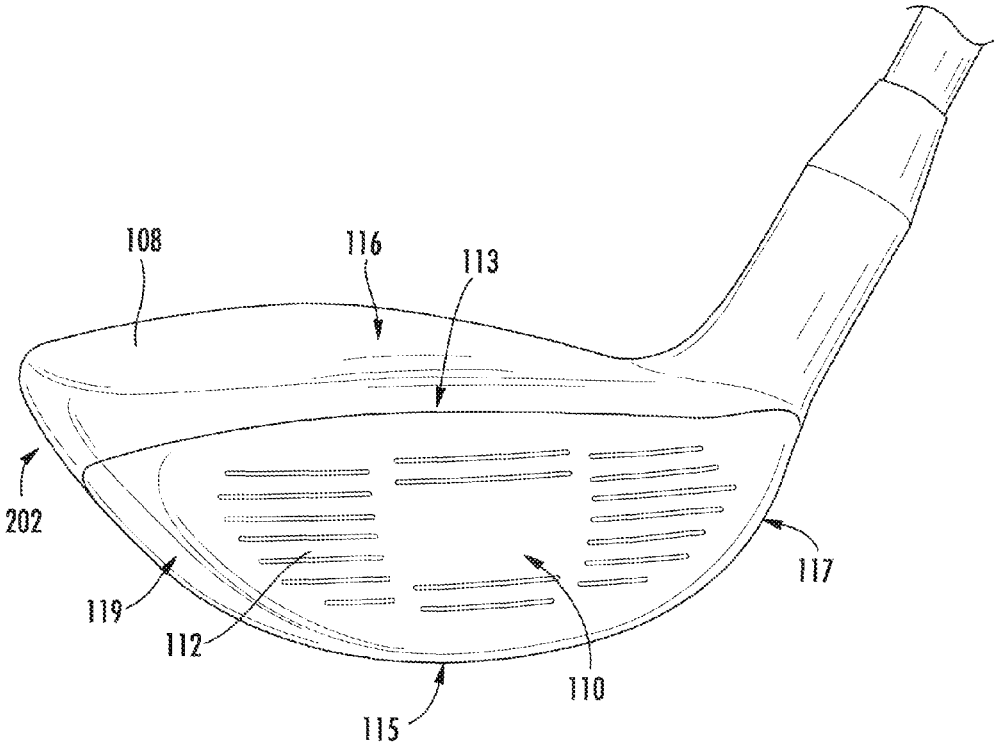
FIG. 7 is a top front perspective view of the ball striking device of FIG. 6.
Figure 8:
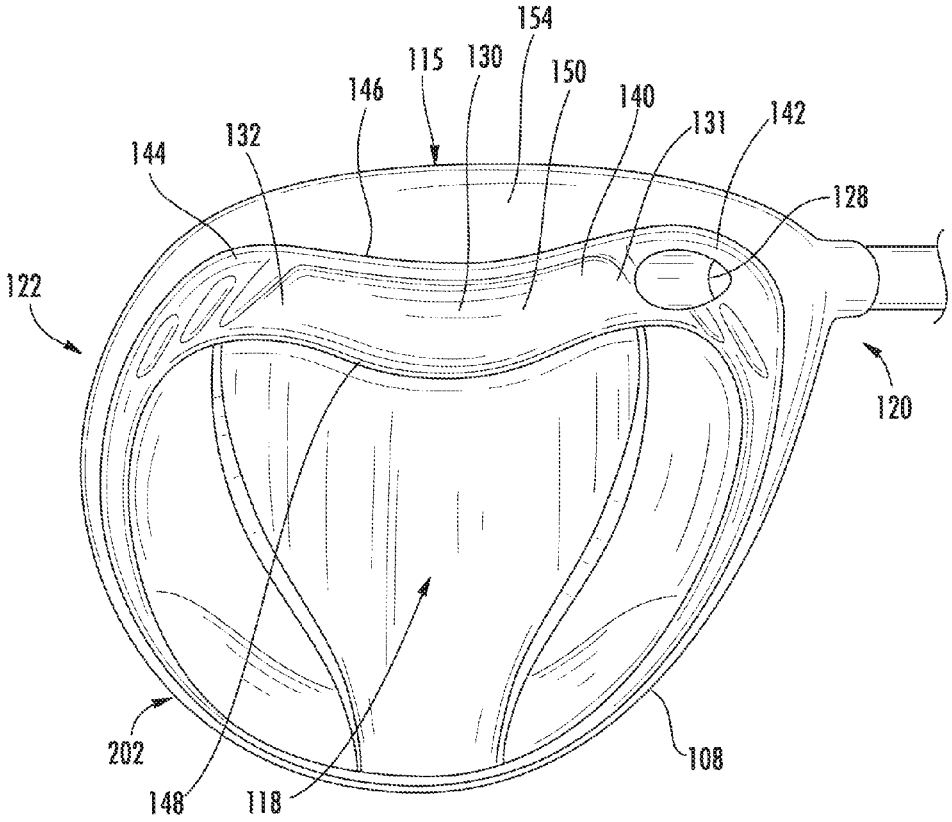
FIG. 8 is a bottom view of the ball striking device of FIG. 6.
Figure 9:
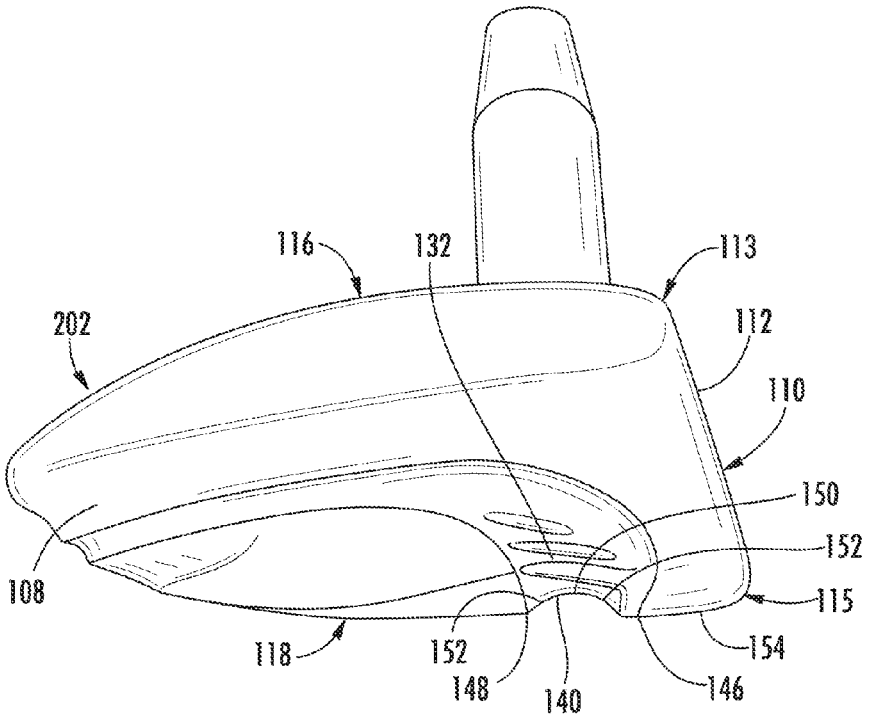
FIG. 9 is a side view of the ball striking device of FIG. 6.
Figure 10:
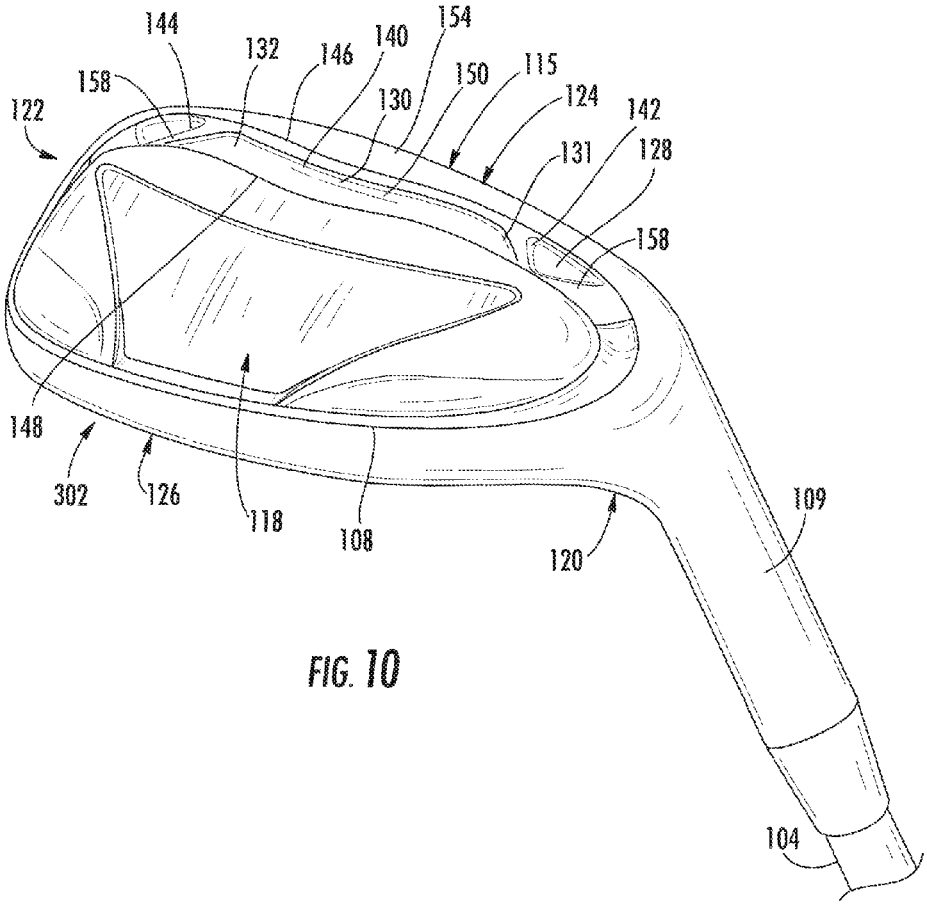
FIG. 10 is a bottom rear perspective view of another embodiment of a ball striking device according to aspects of the present invention, in the form of a golf hybrid.
Figure 11:
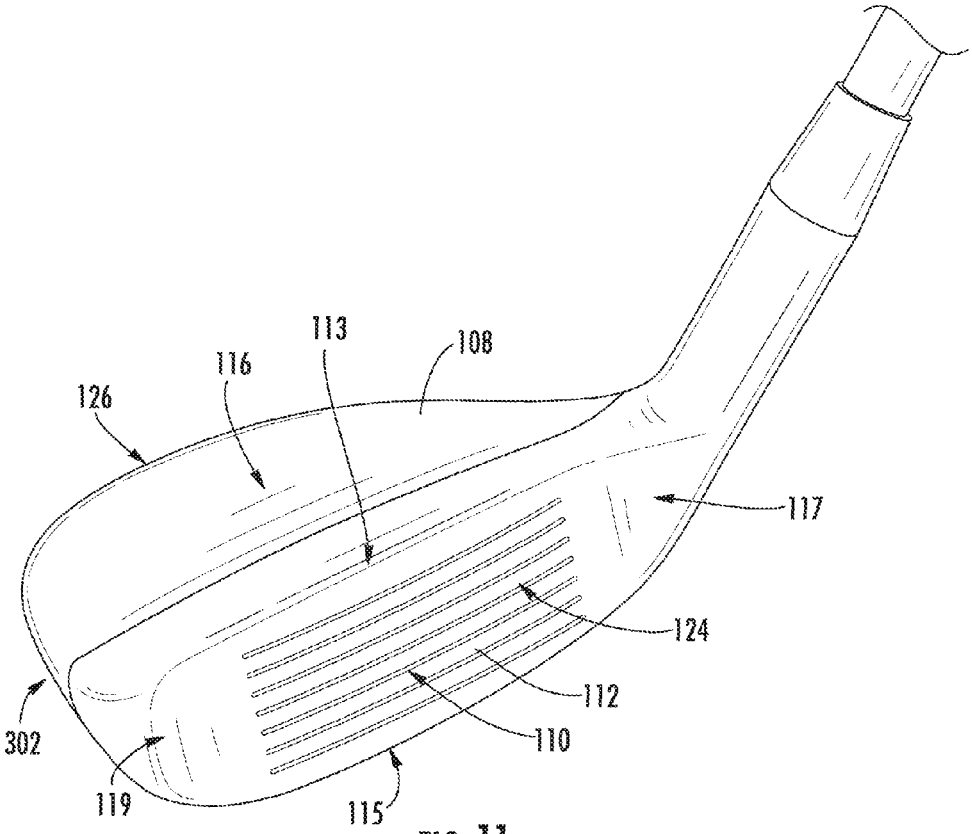
FIG. 11 is a top front perspective view of the ball striking device of FIG. 10.
Figure 12:
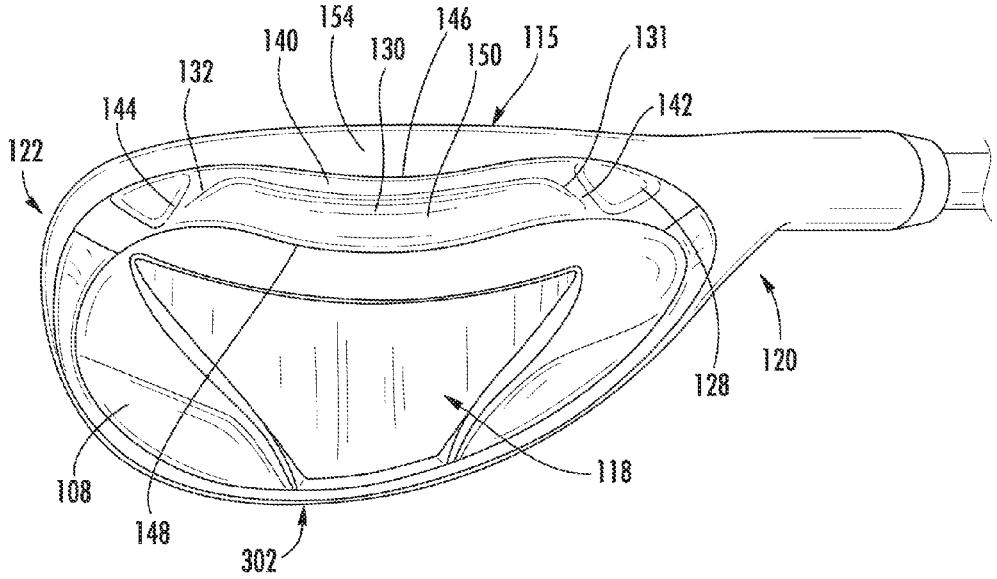
FIG. 12 is a bottom view of the ball striking device of FIG. 10.
Figure 13:
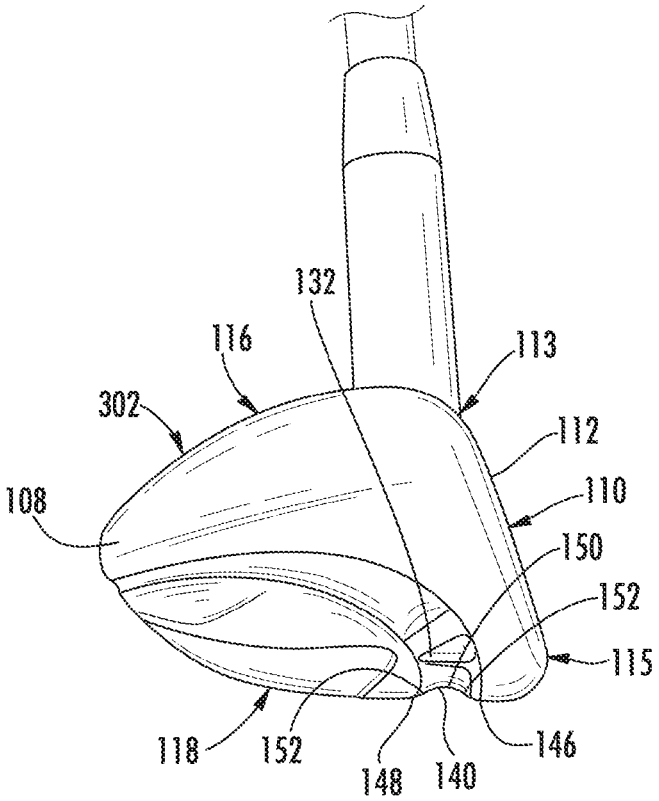
FIG. 13 is a side view of the ball striking device of FIG. 10.

In another embodiment, illustrated in FIG. 5, the head 102 may further include one or more weight members 133 located on the sole 118. These weight members 133 may be releasable and interchangeable, such as by having a snapping connection, a threaded connection, a locking connection (e.g. quarter-turn or half-turn), or other such connection, in order to permit interchanging of the weight members 133 with other weight members 133 having different weights. In another embodiment, the weight members 133 may be more permanently connected to the head 102. It is understood that such weight members permit selective weighting of the head 102, to achieve a desired weight and/or weight distribution.

FIGS. 6-9 illustrate another embodiment of a club head 202 according to aspects of the present invention, in the form of a fairway wood, having a channel 140 as described above with respect to the embodiment of FIGS. 1-4. FIGS. 10-13 illustrate another embodiment of a club head 302 according to aspects of the present invention, in the form of a hybrid club head, having a channel 140 as described above with respect to the embodiment of FIGS. 1-4. The heads 202, 302 in the embodiments of FIGS. 6-9 and FIGS. 10-13 generally have components and features that are similar to the head 102 as described above and shown in FIGS. 1-4, and such similar components and features are identified in FIGS. 6-13 using the same reference numerals as used above and in FIGS. 1-4. Additionally, such similar components and features may not be described again in detail for the sake of brevity. The heads 202, 302 in these embodiments may also produce some or all of the same benefits articulated herein with respect to the head 102 of FIGS. 1-4.

In general, the heads 202, 302 of FIGS. 6-13 each include a channel 140 that is curved and/or bowed as described above with respect to the channel 140 in the embodiment of FIGS. 1-4. The embodiments of FIGS. 6-13 each include a channel 140 that generally has a center portion 130 that is curved and bowed rearwardly, i.e. away from the face 112, and is spaced rearwardly a greater distance from the face 112 than adjacent portions of the channel 140, with heel and toe portions 131, 132 that are located closer to the face 112 than the center portion 130. In these embodiments, the front and rear edges 146, 148 and the trough 150 of each channel 140 are curved and bowed rearwardly, as similarly described above with respect to the channel 140 shown in FIGS. 1-4. Additionally, in the embodiments of FIGS. 6-13, the degrees of curving and bowing of the edges 146, 148 are slightly different, so that the width (measured in the front 124 to rear 126 direction) of each channel 140 is slightly larger at the center portion 130 and slightly narrower at the heel and toe portions 131, 132, as also similarly described above. Further, the spacing portion 154 in each of the embodiments of FIGS. 6-13 is wider proximate the center portion 130 and narrower proximate the heel and toe portions 131, 132 of the channel 140, as also similarly described above. It is understood that any of the variations, modifications, additional features, additional or alternate embodiments, etc., described above with respect to the head 102 of FIGS. 1-4 may be incorporated into the head 202 of FIGS. 6-9 or the head 302 of FIGS. 7-13.

Figure 14:
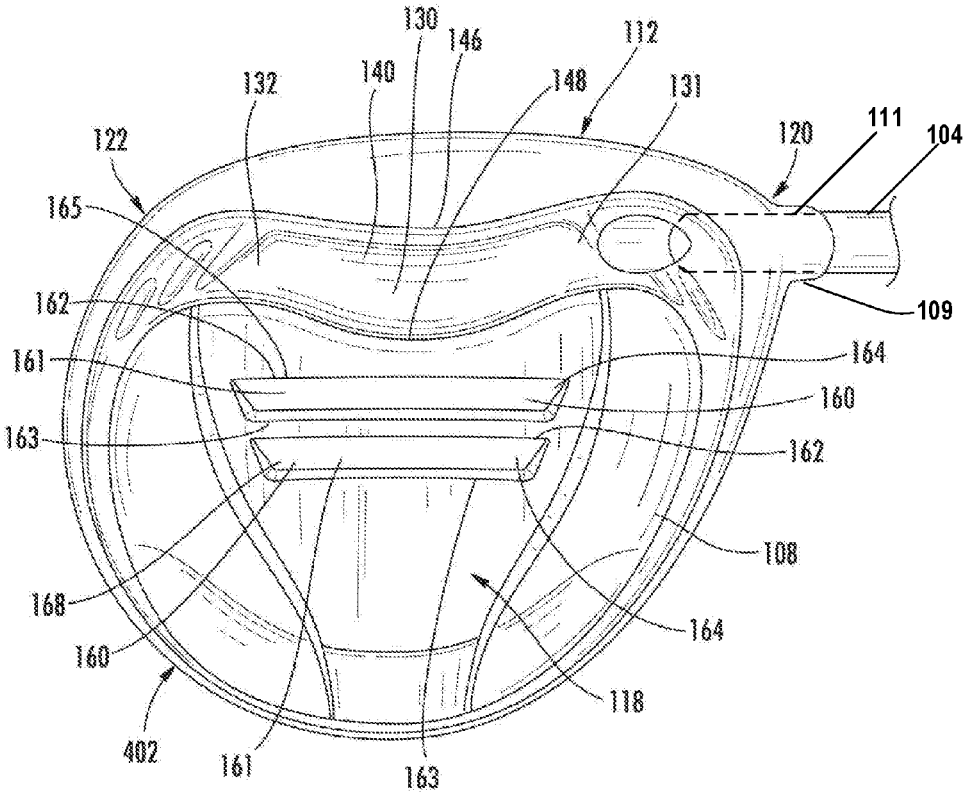
FIG. 14 is a bottom view of another embodiment of a ball striking device according to aspects of the present invention, in the form of a golf driver.
Figure 15:
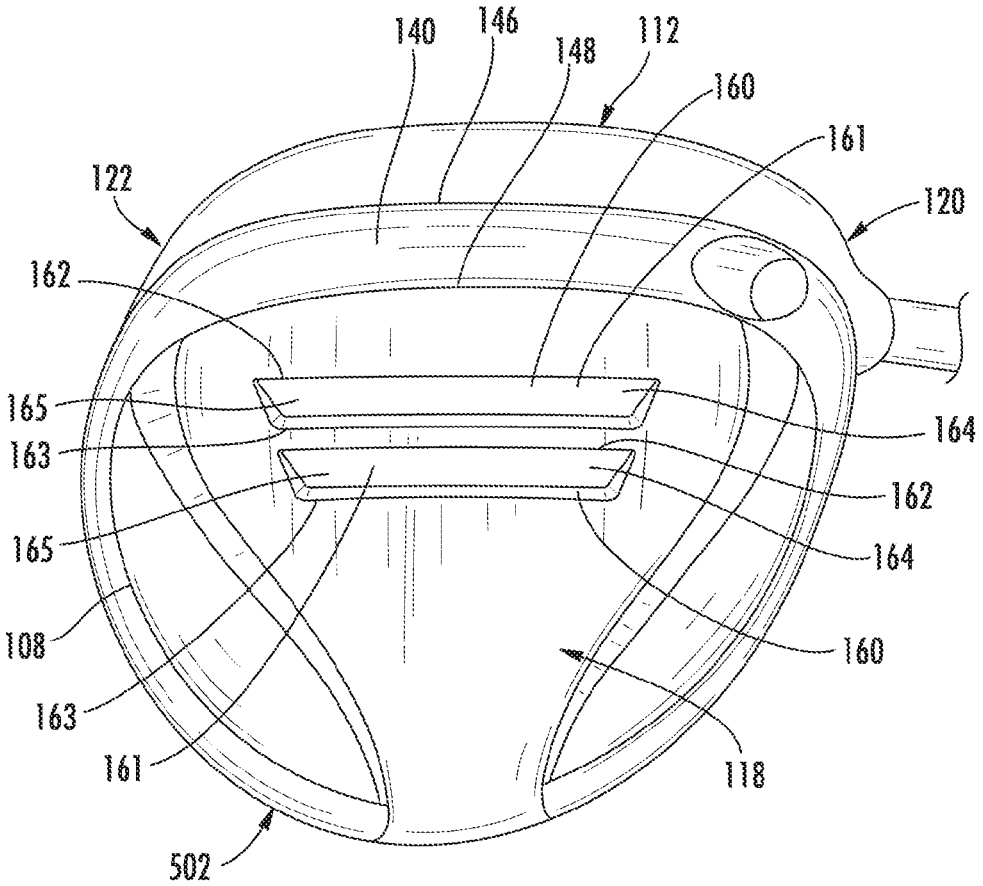
FIG. 15 is a bottom view of another embodiment of a ball striking device according to aspects of the present invention, in the form of a golf driver.

FIGS. 14 and 15 illustrate further embodiments of club heads 402, 502 according to aspects of the present invention, in the form of golf drivers. The heads 402, 502 include at least some components and features that are similar to the head 102 as described above and shown in FIGS. 1-4, and such similar components and features are identified in FIGS. 14-15 using the same reference numerals as used above and in FIGS. 1-4. Additionally, such similar components and features may not be described again in detail for the sake of brevity. The heads 402, 502 in these embodiments may also produce some or all of the same benefits articulated herein with respect to the head 102 of FIGS. 1-4.

The head 402 of FIG. 14 includes a channel 140 that is substantially the same as or identical to the channel 140 of the head 102 of FIGS. 1-4, and may include any of the features and components of the head 102 and the channel 140 described above, including any variations, modifications, additional features, additional or alternate embodiments, etc., described above. The head 502 of FIG. 15 includes a channel 140 that is similar to the channel 140 of FIGS. 1-4, but is generally parallel to the outer periphery of the face 112, including being generally parallel to at least the bottom edge 115 of the face 112. The head 502 of FIG. 15 may include any of the features and components of the head 102 and the channel 140 described above, including any variations, modifications, additional features, additional or alternate embodiments, etc., described above.

The heads 402, 502 of FIGS. 14-15 each include additional channels 160 located on the sole 118, spaced farther rearwardly from the compression channel 140 near the face 112. Each of these additional channels 160 can influence the response, flexing, and other properties of the face 112 and may alter the response force exerted by the channel 140 on the face 112 during impact. In the embodiments of FIGS. 14-15, the additional channels 160 act as internal stiffening ribs to increase the stiffness of the sole 118 and control the flexing of the channel 140 to limit the degree of flexing of the channel 140 during impact. Further, the additional channels 160 may act to provide a foundational "base" for the channel 140, to focus flexing of the sole 118 at the channel 140, rather than other areas of the sole 118. In another embodiment, the head 402, 502 may have stiffening ribs similar to the additional channels 160 that project outwardly from the body 108, rather than inwardly. It is understood that the features of the heads 402, 502 of FIGS. 14-15, including the additional channels/stiffening ribs 160 and any variations, modifications, additional features, additional or alternate embodiments, etc., thereof, may be used in connection with the heads 202, 302 of FIGS. 6-13 or any other embodiments as described herein.

Each of the additional channels 160 in the embodiments of FIGS. 14-15 has an inwardly recessed trough 161 that is defined between a front edge 162 and a rear edge 163 that extend in the heel 120 to toe 122 direction, such that the additional channels 160 are elongated in the heel 120 to toe 122 direction. In this configuration, each of the additional channels 160 has a heel portion 164 on the side most proximate the heel 120 and a toe portion 165 on the side most proximate the toe 122. The first additional channel 160 (the second overall channel) is spaced rearwardly from the rear edge 148 of the channel 140, and the second additional channel 160 (the third overall channel) is spaced rearwardly from the rear edge 163 of the first additional channel 160. Additionally, in this embodiment, the front and rear edges 162, 163 of each of the additional channels 160 are relatively straight, and the additional channels 160 each have a trapezoidal or other polygonal outer shape. Further, in this embodiment, each of the additional channels 160 has a tapering depth that gradually increases from the front edge 162 to the rear edge 163, such that the maximum depth of the trough 161 is located proximate the rear edge 163. This tapering depth may give the additional channels 160 a polygonal cross-sectional shape as well. Still further, the additional channels 160 in this embodiment are substantially symmetrical with respect to a geometric centerline of the head 102 (e.g. extending in the front 124 to rear 126 direction). It is understood that the additional channels 160 may have different shapes, locations, orientations, and/or configurations in other embodiments, and that other embodiments may include a different number of additional channels 160.

Still other embodiments of compression channels 140 can be incorporated into a head 102 of the present invention. Further, it is understood that one or more different features of any of the heads 102, 202, 302, 402, 502 and the channels 140 described above with respect to FIGS. 1-15 can be combined in any combination in other embodiments.

Heads 102, et seq., incorporating the channels 140 disclosed herein may be used as a ball striking device or a part thereof. For example, a golf club 100 as shown in FIGS. 1-4 may be manufactured by attaching a shaft or handle 104 to a head that is provided, such as the heads 102, et seq., as described above. "Providing" the head, as used herein, refers broadly to making an article available or accessible for future actions to be performed on the article, and does not connote that the party providing the article has manufactured, produced, or supplied the article or that the party providing the article has ownership or control of the article. Additionally, a set of golf clubs including one or more clubs 100 having heads 102, et seq., as described above may be provided. In other embodiments, different types of ball striking devices can be manufactured according to the principles described herein. Additionally, the heads 102, et seq., golf club 100, or other ball striking device may be fitted or customized for a person, such as by attaching a shaft 104 thereto having a particular length, flexibility, etc., or by adjusting or interchanging an already attached shaft 104 as described above.

The ball striking devices and heads therefor as described herein provide many benefits and advantages over existing products. For example, the flexing of the sole 118 at the channel 140 results in a smaller degree of deformation of the ball, which in turn can result in greater impact efficiency and greater energy and velocity transfer to the ball during impact. As another example, the more gradual impact created by the flexing can create a longer impact time, which can also result in greater energy and velocity transfer to the ball during impact. As a further example, the responsive or reactive force exerted on the face 112 as the compressed channel 140 expands to return to its initial shape is imparted to the ball, which can result in greater energy and velocity transfer to the ball during impact. Still further, because the channel 140 extends toward the heel and toe edges 117, 119 of the face 112, the head 102, et seq., can achieve increased energy and velocity transfer to the ball for impacts that are away from the center or traditional "sweet spot" of the face 112. As an additional example, the features described herein may result in improved feel of the golf club 100 for the golfer, when striking the ball. Additionally, the configuration of the channel 140 may work in conjunction with other features (e.g. the additional channels 160, the access 128, etc.) to influence the overall flexibility and response of the channel 140, as well as the effect the channel 140 has on the response of the face 112. Further benefits and advantages are recognized by those skilled in the art.

While the invention has been described with respect to specific examples including presently preferred modes of carrying out the invention, those skilled in the art will appreciate that there are numerous variations and permutations of the above described systems and methods. Thus, the spirit and scope of the invention should be construed broadly as set forth in the appended claims.

What is claimed is:

1. A golf club head comprising:

a face having a striking surface configured for striking a ball, the face being defined by an outer periphery;

a body connected to the face and extending rearwardly from the outer periphery of the face, the body having a sole configured to face a playing surface, a crown opposite the sole, a heel, and a toe;

an internal interconnection structure adapted for connection of a shaft to the body in an adjustable configuration;

a channel extending across at least a portion of the sole of the body, wherein the channel is defined between a front edge and a rear edge extending in a heel-to-toe direction and is inwardly recessed between the front and rear edges; and an access opening within the sole, the access opening providing access to the internal interconnection structure, wherein the access opening is in communication with the channel between the face and the rear edge of the channel, wherein the front edge of the channel is generally parallel to the outer periphery of the face at a center portion of the channel, wherein a portion of the channel curves away from the face and extends near a heel edge and a toe edge of the sole into the heel and toe areas with a deepest portion of the channel located near the face of the golf club head, wherein a width of the channel defined between the front and rear edges is greater proximate a center portion as compared to both a heel portion and a toe portion.

2. A golf club head of claim 1, wherein at least one releasable weight member is positioned rearward of the channel and proximate a center sole region in the heel-to-toe direction and a center portion of the sole in a front-to-back direction.

3. A golf club head of claim 1, wherein the club head has a volume in a range of 120 cc to 230 cc.

4. A golf club head of claim 1, wherein the club head has a volume in a range of 85 cc to 140 cc.

5. A golf club head of claim 1, wherein at least two releasable weight members are positioned in a center sole region in a heel-to-toe direction.

6. A golf club head of claim 1, wherein the club head has a volume of at least 400 cc.

* * * * *